US007866783B2

(12) United States Patent
Tsuji et al.

(10) Patent No.: US 7,866,783 B2
(45) Date of Patent: Jan. 11, 2011

(54) INKJET RECORDING APPARATUS

(75) Inventors: Kikunosuke Tsuji, Osaka (JP); Takayuki Okumura, Osaka (JP)

(73) Assignee: Kyocera Mita Corporation (JP)

( * ) Notice: Subject to any disclaimer, the term of this patent is extended or adjusted under 35 U.S.C. 154(b) by 463 days.

(21) Appl. No.: 12/038,331

(22) Filed: Feb. 27, 2008

(65) Prior Publication Data

US 2008/0218550 A1 Sep. 11, 2008

(30) Foreign Application Priority Data

Mar. 7, 2007 (JP) ..... 2007-056834

(51) Int. Cl.
*B41J 29/393* (2006.01)
*B41J 2/165* (2006.01)

(52) U.S. Cl. ..... 347/19; 347/22

(58) Field of Classification Search ..... None
See application file for complete search history.

(56) References Cited

U.S. PATENT DOCUMENTS 6,863,366 B2 * 3/2005 Premnath et al. ..... 347/22
6,979,071 B2 * 12/2005 Suzuki et al. ..... 347/22
2006/0214983 A1 9/2006 Teshima et al.

FOREIGN PATENT DOCUMENTS

| | | |
|---|---|---|
| JP | 8-150710 | 6/1996 |
| JP | 2005-212276 | 8/2005 |
| JP | 2005-319650 | 11/2005 |
| JP | 2006-264174 | 10/2006 |

* cited by examiner

*Primary Examiner*—Omar Rojas
(74) *Attorney, Agent, or Firm*—Gerald E. Hespos; Michael J. Porco

(57) ABSTRACT

An inkjet recording apparatus which discharges ink onto a recording medium to form an image, the inkjet recording apparatus including: a recording head having a nozzle for discharging ink; a conveying belt for supporting a recording medium and conveying the recording medium to a position facing the nozzle; a cleaning roller for cleaning the conveying belt; a cleaning liquid storage section for storing cleaning liquid to be applied to the cleaning roller; a contamination detector for detecting a density of contamination of the cleaning liquid stored in the cleaning liquid storage section; a liquid supplying section for controlling supply of cleaning liquid to the cleaning liquid storage section in accordance with a density of contamination detected by the contamination detector; and a liquid draining section for draining at least a part of the cleaning liquid from the cleaning liquid storage section.

19 Claims, 12 Drawing Sheets

INKJET RECORDING APPARATUS

BACKGROUND OF THE INVENTION

1. Field of the Invention

The present invention relates to an inkjet recording apparatus and, more particularly, to an inkjet recording apparatus provided with a conveying belt for conveying a recording medium.

2. Description of the Related Art.

In recent years, an inkjet recording apparatus is widely used as an apparatus for forming images on various recording mediums. Such inkjet recording apparatus uses a plurality of nozzles to discharge ink onto a recording medium conveyed to a position facing the nozzles so that an image is formed on a recording medium. Therefore, an inkjet recording apparatus is advantageous in that it is small and inexpensive, is quiet during operation, and is capable of forming a fine image.

In such inkjet recording apparatus, a method of using a conveying belt may be adopted as a method for conveying a recording medium to a nozzle-facing position. According to this method, a recording medium is supported on a surface of a conveying belt and conveyed to the nozzle-facing position, and an image is formed on the recording medium while the recording medium is supported on the surface of the conveying belt. At this time, ink discharged from the nozzle may adhere to the conveying belt. For example, in the case where a recording medium is made of material such as fabric which may allow ink to pass therethrough, ink may pass through the recording medium and adhere to the conveying belt. Further, even in the case where the recording medium is made of a recording sheet which is not likely to allow ink to pass therethrough, if an image is formed on a whole area of the recording sheet without providing a space on edge, ink may adhere to the surface of the conveying belt in an area beyond outer edge of the recording medium. When a recording medium following the previous recording sheet is supported on the conveying belt to which ink adheres, it causes a problem that a back surface of the following recording medium may be contaminated.

Therefore, in an inkjet recording apparatus provided with a conveying belt, a cleaning section for cleaning a surface of the conveying belt to remove ink adhered to the surface of the conveying belt. As a configuration of such cleaning section, there has been a known configuration of providing a cleaning roller which comes in contact with a conveying belt on a downstream side of a position where a recording medium is separated apart from the conveying belt (for example, refer to Japanese Patent Publication No. 2005-212276). A part of the cleaning roller is soaked in cleaning liquid stored in a container. According to this configuration, a cleaning roller rotates with movement of the conveying belt in a state of being in contact with the conveying belt, so that ink adhered to the surface of the conveying belt is removed. Further, ink adhered to the cleaning roller is separated from the cleaning roller and disperses in cleaning liquid when the cleaning roller is in a state of being soaked in cleaning liquid stored in the container.

In the cleaning section having such configuration as described above, amount of ink in cleaning liquid stored in the container gradually increases as cleaning of the conveying belt is repeatedly performed. When the amount of ink in cleaning liquid becomes great, it gradually becomes difficult to remove ink from the cleaning roller. In this case, ink adhered to the conveying belt becomes also difficult to be removed. Further, when the cleaning roller is soaked in cleaning liquid stored in the container, ink in cleaning liquid adheres to the cleaning roller, so that ink adhered to the cleaning roller is likely to adhere to the conveying belt. Therefore, cleaning liquid stored in the container is replaced with new cleaning liquid as needed.

Such replacement of cleaning liquid is performed automatically, for example, when a length of movement of the conveying belt in contact with the cleaning roller reaches a prescribed length, or when a time length of movement of the conveying belt in contact with the cleaning roller reaches a prescribed time length. However, the amount of ink adhered to conveying belt varies depending on an image recording condition. Therefore, in a control of replacing cleaning liquid at a time of reaching the prescribed length or prescribed time length, it may cause a situation where cleaning liquid still having sufficient cleaning ability is replaced and a situation where cleaning liquid including a large amount of ink is not replaced. In summary, it may cause a situation where cleaning liquid is wastefully lost and a situation where the conveying belt cannot be cleaned sufficiently.

As a countermeasure to this, Japanese Patent Unexamined Publication No. 2005-212276 discloses a technology of changing a supply rate of cleaning liquid in accordance with an image recording condition such as a kind of recording medium, size of image, and amount of use of ink. This document indicates that a cleaning belt can be cleaned efficiently and sufficiently by adopting the disclosed technology.

With the technology disclosed in the document, the conveying belt can be adequately cleaned as long as a recording medium of a kind which is set is normally conveyed. However, in an actual inkjet recording apparatus, abnormality in conveyance of recording medium may sometimes occur. For example, there are cases where a recording medium jams during conveyance and where a recording sheet is conveyed in a state where it has deformation such as ripping and bending, and curling. In such cases, the recording medium is not at its proper position on the conveying belt, so that ink is discharged directly onto the surface of the conveying belt. Further, a user may mistakenly supply a recording medium which is different from a recording medium of a kind which is set. In this case, the amount of ink adhered to the conveying belt may be different from the amount which supposed to be in the case where the recording medium of a kind which is set is conveyed. In other words, it may cause at least a situation where the conveying belt is contaminated more than expected, or a situation where the conveying belt is not contaminated as expected.

As described above, it would be difficult to estimate contamination of cleaning liquid only in accordance with an image recording condition. Therefore, the technology disclosed in the document has a problem that it may cause at least a situation where cleaning liquid having sufficient cleaning ability is replaced, or a situation where cleaning liquid including a large amount of ink is not replaced.

SUMMARY OF THE INVENTION

The present invention has been made to solve the problems described above, and its object is to provide an inkjet recording apparatus capable of maintaining adequate cleaning ability and efficiently cleaning a conveying belt without wastefully losing cleaning liquid.

In other words, according to an aspect of the present invention, an inkjet recording apparatus which discharges ink onto a recording medium to form an image comprises: a recording head having a nozzle for discharging ink; a conveying belt for supporting a recording medium and conveying the recording medium to a position facing the nozzle; a cleaning roller for cleaning the conveying belt; a cleaning liquid storage section for storing cleaning liquid to be applied to the cleaning roller; a contamination detector for detecting a density of contamination of the cleaning liquid stored in the cleaning liquid storage section; a liquid supplying section for controlling supply of cleaning liquid to the cleaning liquid storage section in accordance with a density of contamination detected by the contamination detector; and a liquid draining section for draining at least a part of the cleaning liquid from the cleaning liquid storage section.

These and other objects, features and advantages of the present invention will become more apparent upon reading of the following detailed description along with the accompanied drawings.

DETAILED DESCRIPTION OF THE PREFERRED EMBODIMENTS

Hereinafter, an inkjet recording apparatus in accordance with an embodiment of the present invention will be described with reference to the drawings.

First Embodiment

Figure 1:
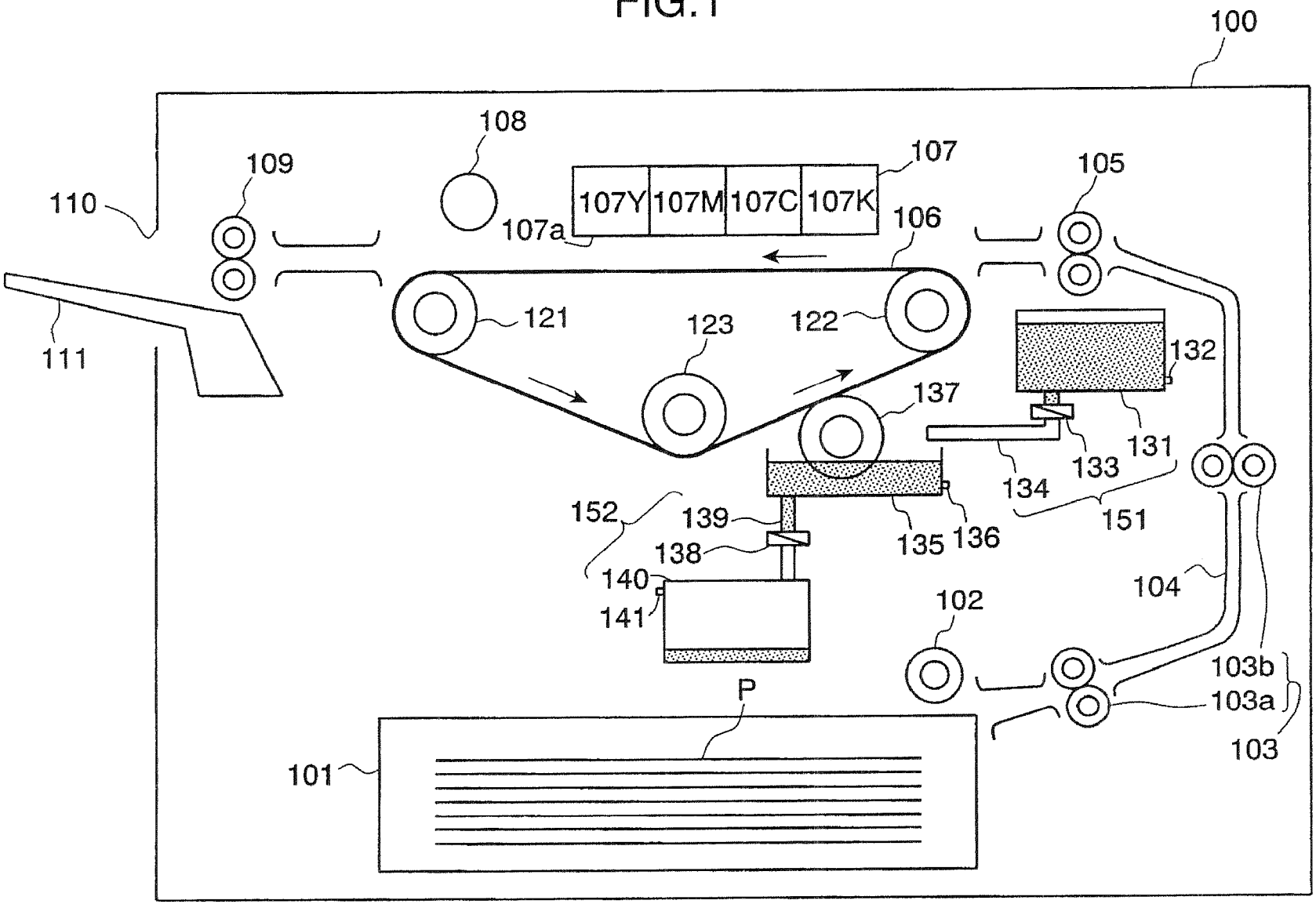
FIG. 1 shows an example of an overall configuration of an inkjet recording apparatus adopting the present invention.

FIG. 1 shows an overall configuration of an inkjet recording apparatus in accordance with the present embodiment. As shown in FIG. 1, an inkjet recording apparatus 100 includes a sheet-feeding cassette 101 for accommodating a sheet P being a recording medium, a sheet conveying passage 104 being a conveying passage of the sheet P, and a conveying belt 106 for conveying the sheet P to a sheet-discharging tray 111.

The sheet-feeding cassette 101 is provided in a lower portion of an apparatus main body and accommodates the sheet P to which image forming is performed. The sheet-feeding cassette 101 is provided with a sheet-feeding roller 102 for performing sheet feeding. The sheet-feeding roller 102 sequentially feeds sheets P accommodated in the sheet-feeding cassette 101 to the sheet conveying passage 104. The sheet conveying passage 104 includes a guide plate for guiding the sheet P fed from the sheet-feeding cassette 101 to the conveying belt 106. The sheet conveying passage 104 is provided with a first pair of conveying rollers 103*a* and a second pair of conveying rollers 103*b* sequentially from a side of the sheet-feeding cassette 101 for conveying the sheet P. On a side of the conveying belt 106, there is provided a pair of registration rollers 105 for performing secondary sheet-feeding. Thus, the sheet P fed from the sheet-feeding cassette 101 is conveyed by pairs of conveying rollers 103 (103*a*, 103*b*) to the pair of registration rollers 105, and the pair of registration rollers 105 sends the sheet P to the conveying belt 106 at a predetermined timing.

The conveying belt 106 conveys the sheet P secondarily fed by the pair of registration rollers 105 to the sheet-discharging tray 111. The conveying belt 106, which is an endless belt, extends between a driving roller 121, a driven roller 122, and a tension roller 123. The conveying belt 106 runs (moves) in an arrow direction shown in FIG. 1 by rotational driving of the driving roller 121. Here, the driving roller 121 is provided on downstream in a sheet conveying direction. The driven roller 122 is provided on upstream in the sheet conveying direction. The sheet P is conveyed by the conveying belt 106 between the driven roller 122 and the driving roller 121. Further, the tension roller 123 is provided at a position between the driving roller 121 and the driven roller 122 and lower than the driving roller 121 and the driven roller 122. A tensional force applied to the conveying belt 106 is adjusted by changing a vertical position of the tension roller 123. In the present embodiment, only the driving roller 121 is driven by a driving section such as a motor. The driven roller 122 and the tension roller 123 are rotated by movement of the conveying belt 106 which is moved by rotation of the driving roller 121.

Further, the inkjet recording apparatus 100 is provided with a recording head 107 for discharging ink. The recording head 107 includes line heads 107Y, 107M, 107C, 107K respectively discharging ink of yellow (Y), magenta (M), cyan (C), and black (K). Each of the line heads 107Y, 107M, 107C, 107K discharges ink with the following configuration.

In nozzle surface 107*a* formed on a lower surface side of the recording head 107, a plurality of nozzles are aligned in a sheet width direction within a length of a sheet width for each of the line heads 107Y, 107M, 107C, 107K. Each nozzle is in communication with a pressure chamber (not illustrated) formed in the line heads 107Y,107M,107C,107K and associated respectively for each nozzle. Further, each pressure chamber is in communication also with an ink liquid chamber (not illustrated) formed in each of the line heads 107Y, 107M, 107C, 107K. Each ink liquid chamber is in communication with an ink tank of associated color through an ink feeding tube (not illustrated), so that ink is fed from the ink tank. Each of the line heads 107Y, 107M, 107C, 107K prints image data and the like, which is received from other equipment through a network with use of an unillustrated network adaptor and the like, onto the sheet P conveyed by the conveying belt 106.

Further, on downstream of the recording head 107, there is provided a drying apparatus 108 for drying ink discharged from the recording head 107 to the sheet P. The sheet P having been passed through the drying apparatus 108 is discharged to the sheet-discharging tray 111 by a pair of sheet-discharging rollers 109 provided on downstream of the conveying belt 106 through a sheet-discharging slot 110 formed in a side wall of the main body of the inkjet recording apparatus.

Further, at a position on downstream of the tension roller 123 in the moving direction of the conveying belt 106 and upstream of the driven roller 122 in the moving direction of the conveying belt 106, there is provided a cleaning roller 137 in contact with the conveying belt 106. Here, the cleaning roller 137 is provided movably in a vertical direction and urged to the conveying belt 106 by an urging member such as a spring. It should be understood that a position of the cleaning roller 137 is not limited to the position shown in FIG. 1. The cleaning roller 137 may be so arranged that it comes in contact with the surface of the conveying belt 106 at a position other than a position at which the conveying belt 106 holds the recording medium. In other words, the cleaning roller 137 can be provided at any position as long as the cleaning roller 137 comes in contact with the conveying belt 106 at a position which is out of a range where the conveying belt 106 supports the sheet P.

Under the cleaning roller 137, there is provided a cleaning liquid storage section 135 as a container capable of storing cleaning liquid. The cleaning liquid is, for example, water solution having 1% of Surfinol 465 (registered trademark) as a surface-activating agent, 15% of glycerin as a solvent, and the like. An upper side of the cleaning liquid storage section 135 is open, and a part of the cleaning roller 137 is soaked in cleaning liquid stored in the cleaning liquid storage section 135 from upper side. A surface of the cleaning roller 137 (a contact surface to the conveying belt 106) consists of material which allows wastes not to be adhered to the conveying belt 106 and absorbs cleaning liquid. In the present embodiment, the surface of the cleaning roller 137 is non-woven fabric.

To a bottom portion of the cleaning liquid storage section 135, a liquid draining pipe 139 is connected. The liquid draining pipe 139 is provided with a liquid draining valve 138 which is an electromagnetic valve so configured as to be openable and closable. One end of the liquid draining pipe 139 is connected to the cleaning liquid storage section 135, but the other end of the liquid draining pipe 139 is connected to a liquid drainage tank 140. Opening the liquid draining valve 138 allows cleaning liquid stored in the cleaning liquid storage section 135 to flow into the liquid drainage tank 140. Further, the liquid drainage tank 140 is provided with a liquid amount detector 141 for detecting whether the amount of liquid stored in the liquid drainage tank 140 comes close to an upper limit capacity of the liquid drainage tank 140. The liquid amount detector 141 is arranged, for example, in vicinity of a position where a height of liquid level in the liquid drainage tank 140 reaches an upper limit capacity. The liquid amount detector 141 has the same configuration as that of a contamination degree detector 136 which will be described hereinafter. Only a light emitting device is illustrated in the drawing, and a light receiving device is not illustrated. Whether the amount of liquid in the liquid drainage tank 140 reaches the upper limit capacity is detected in accordance with presence or absence of reception of light by the light receiving device. In other words, the liquid amount detector 141 detects a height of liquid level in the liquid drainage tank 140 to detect whether the amount comes close to the upper limit capacity. Further, when liquid amount detector 141 detects that the amount of liquid comes close to the upper limit capacity, it outputs a signal indicating the detection result to a determining section 403 (refer to FIG. 4), and the determining section 403 may allow an unillustrated alarming section to give an alarm for prompting disposal of waste liquid in the liquid drainage tank 140. The alarm is given in any manner such as displaying notification or giving a sound which can be noticed by a user. In the present embodiment, the liquid draining valve 138, the liquid draining pipe 139, and the liquid drainage tank 140 constitute a liquid draining section 152.

On the other hand, above the cleaning liquid storage section 135, a liquid supply pipe 134 for supplying new cleaning liquid to the cleaning liquid storage section 135 is arranged. The liquid supply pipe 134 is provided with a liquid supply valve 133 which is an electromagnetic valve so configured as to be openable and closable. One end of the liquid supply pipe 134 is arranged above the cleaning liquid storage section 135, and the other end of the liquid supply pipe 134 is connected to a main tank 131. The main tank 131 accommodates fresh cleaning liquid. When the liquid supply valve 133 is opened, cleaning liquid flows into the cleaning liquid storage section 135 from the main tank 131. The main tank 131 is provided with a remaining amount detector 132 for detecting whether a remaining amount of cleaning liquid in the main tank 131 is small. The remaining amount detector 132 is arranged, for example, in vicinity of a position where a liquid level is at a height corresponding to that the remaining amount of cleaning liquid stored in the main tank 131 is a predetermined minimum amount. In other words, the remaining amount detector 132 detects, for example, a height of liquid level in the main tank 131 to detect whether the remaining amount of cleaning liquid is small. The remaining amount detector 132 has a configuration which is same as that of a contamination degree detector 136 which will be described hereinafter. Only the light emitting device is illustrated, and the light receiving device is not illustrated. Whether the amount of liquid in the main tank 131 is smaller than the minimum amount is detected in accordance with presence or absence of reception of light by the light receiving device. When the remaining amount detector 132 detects that the remaining amount is small, it outputs a signal indicating the detection result to the determining section 403, and the determining section 403 allows the unillustrated alarming section to give an alarm for prompting re-supply of cleaning liquid to the main tank 131 in any manner such as displaying notification or giving a sound which can be noticed by a user. In the present embodiment, the liquid supply valve 133, the liquid supply pipe 134, and the main tank 131 constitute a liquid supplying section 151.

Figure 2:
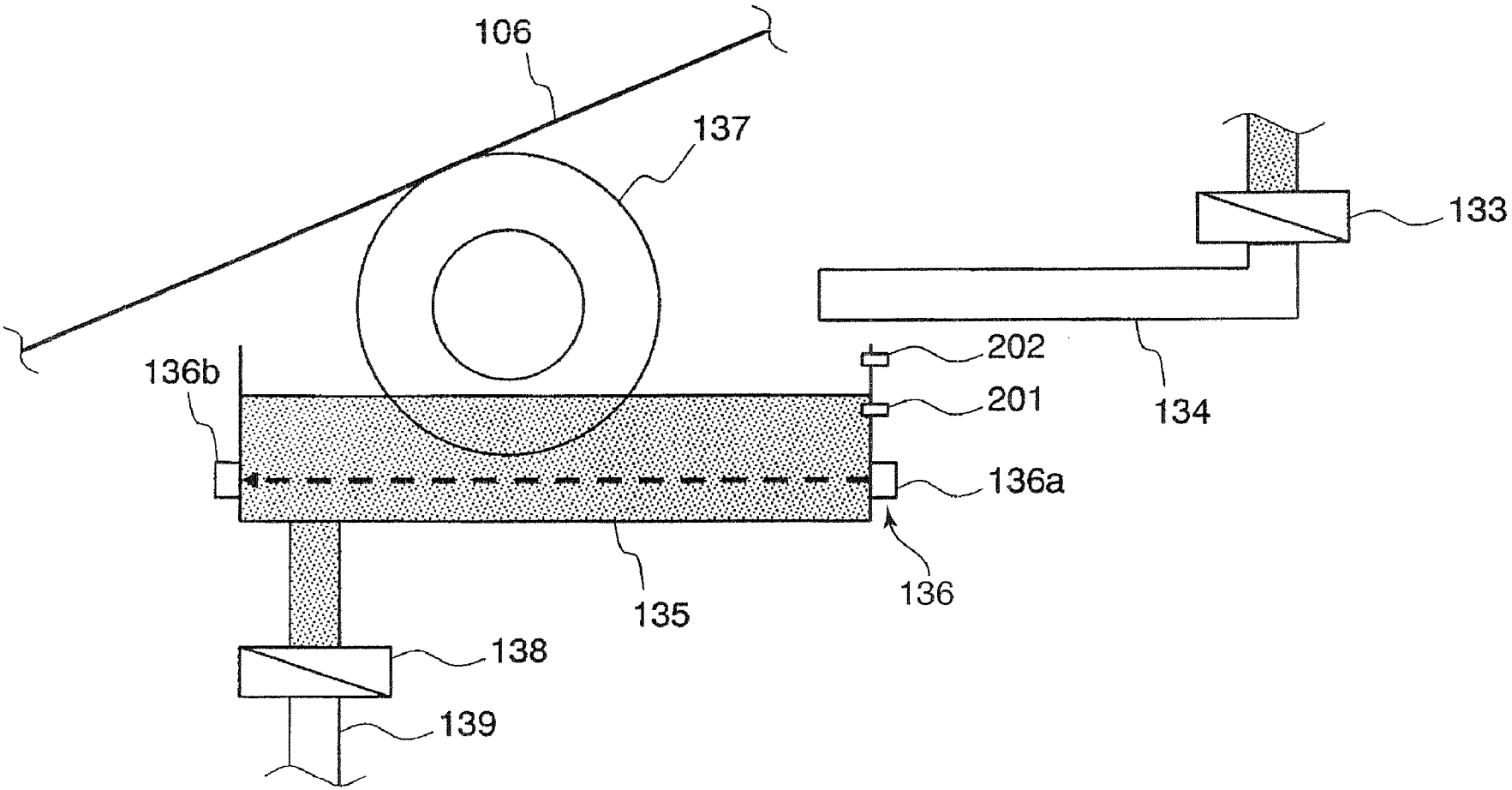
FIG. 2 is an enlarged view showing configurations of relevant parts of FIG. 1.

In the inkjet recording apparatus 100 of the present embodiment, the cleaning liquid storage section 135 is provided a contamination degree detector (an example of a contamination detector) 136. The contamination degree detector 136 detects a contamination degree of ink which is removed from the conveying belt 106 by the cleaning roller 137 and disperses in cleaning liquid stored in the cleaning liquid storage section 135. FIG. 2 is an enlarged view showing a configuration of vicinity of the cleaning liquid storage section 135.

As shown in FIG. 2, in the present embodiment, the contamination degree detector 136 includes a transmission type light sensor provided with a light emitting section **136*a* and a light receiver 136*b*. The light emitting section 136*a* is provided in contact with an outer side of a side wall of the cleaning liquid storage section 135, and the light receiver 136*b* is provided in contact with an outer side of a side wall facing the side wall on which the light emitting section 136*a* is provided. At least portions of side walls of the cleaning liquid storage section 135 where the light emitting section 136*a* and the light receiver 136*b*** are provided are made of light-transmissive material such as glass or acrylic material.

For the purpose of preventing ink from being fixedly adhered to the portions of the side walls of cleaning liquid storage section 135 where the light emitting section 136*a* and the light receiver 136*b* are provided, it is preferable to provide cleaning members such as wipers for cleaning these portions are provided.

The light emitting section 136*a* is provided with a light emitting device such as, for example, an LED (Light Emitting Diode). Further, the light receiver 136*b* is provided with a light receiving device which is capable of outputting a voltage signal in accordance with a strength of light irradiated by the light emitting section 136*a* in a predetermined wavelength area. As shown in FIG. 2 with a broken line, the light irradiated from the light emitting section 136*a* passes through cleaning liquid stored in the cleaning liquid storage section 135 and reaches the light receiver 136*b*. In this case, when the amount of ink included in cleaning liquid increases, the light is scattered by ink included in the cleaning liquid, so that the strength of light reaching the light receiver 136*b* is reduced. For example, in the inkjet recording apparatus 100, a table storing in advance a relationship between the strength of light reaching the light receiver 136*b* (output voltage of the light receiver 136) and the amount of ink included in cleaning liquid (hereinafter, referred to as ink contamination degree) is stored in an unillustrated storage section, and an ink contamination degree corresponding to a strength of light reaching the light receiver 136*b* is read from the table, so that an ink contaminating degree in cleaning liquid stored in the cleaning liquid storage section 135 is detected.

Further, the cleaning liquid storage section 135 is provided with liquid level sensors 201, 202 for detecting a liquid level of cleaning liquid. When the liquid level of cleaning liquid lowers, ink adhered to the cleaning roller 137 cannot be removed sufficiently. Therefore, the liquid level lower limit sensor 201 is provided at a lower limit position of the liquid level of cleaning liquid (in other words, at a height of the liquid level in the case where the minimum amount of cleaning liquid is stored so that sufficient amount of cleaning liquid for cleaning the conveying belt 106 can be applied to the cleaning roller 137). Further, when the liquid level of cleaning liquid rises, cleaning liquid overflows from the cleaning liquid storage section 135. Therefore, the liquid level upper limit sensor 202 is provided at an upper limit position of the liquid level of cleaning liquid (upper limit height under which the overflow does not occur). The liquid level sensors 201, 202 have a configuration which is same as that of the contamination degree detector 136. Only the light emitting device is illustrated, and the light receiving device is not unillustrated.

Figure 3:
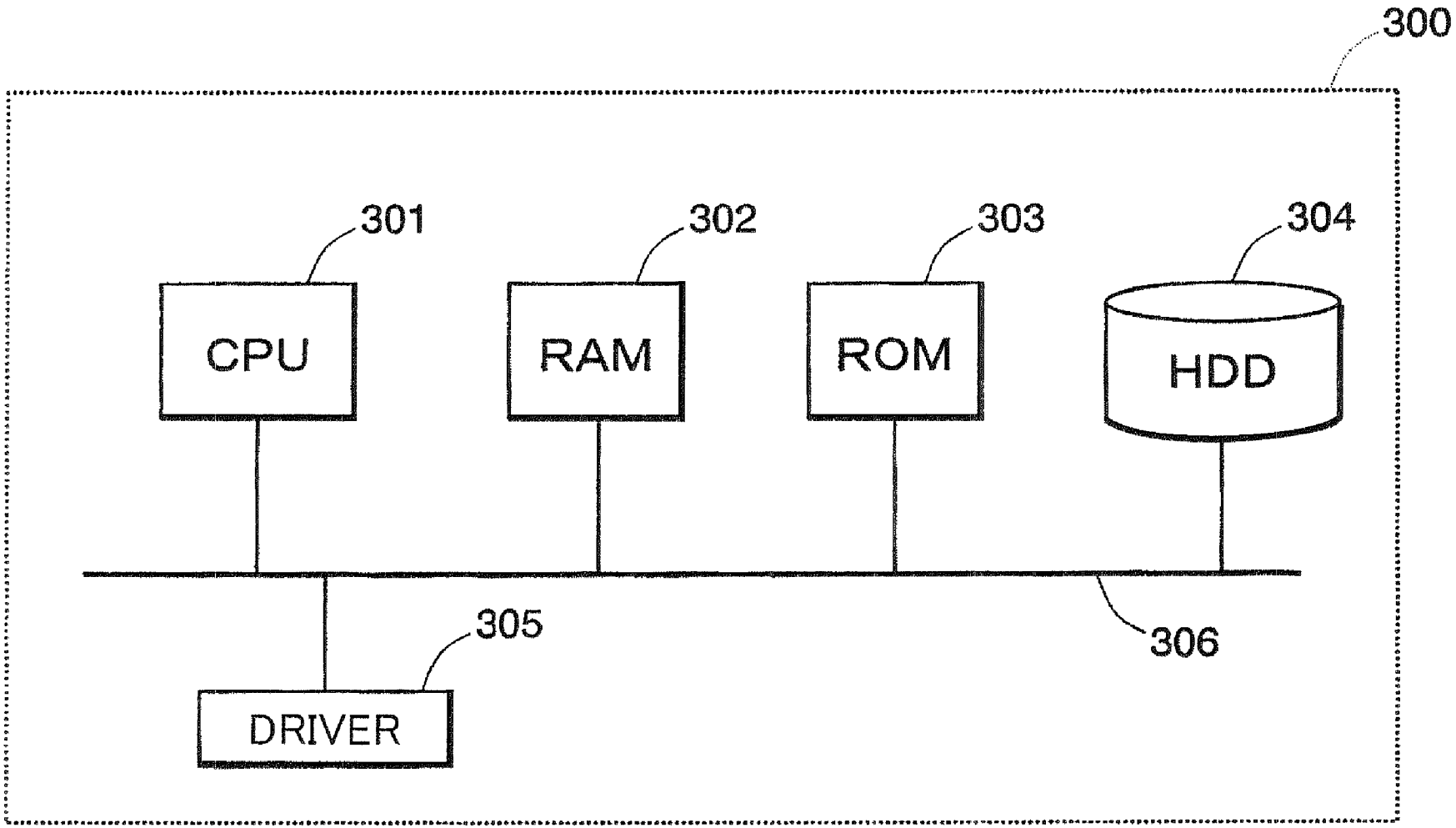
FIG. 3 shows an example of a control system of the inkjet recording apparatus in accordance with an embodiment of the present invention.

FIG. 3 shows a control system of the inkjet recording apparatus 100 in accordance with the present embodiment. A controller 300 includes a CPU (Central Processing Unit) 301, a RAM (Random Access Memory) 302, a ROM (Read Only Memory) 303, an HDD (Hard Disk Drive) 304, and driver 305 associated with driving portions such as the conveying belt 106 and the conveying roller 103, which are connected via an internal bus 306. The CPU 301 uses, for example, the RAM 302 as a working area and executes a program stored in the ROM 303, the HDD 304, and the like to give and receive data and instruction to and from the driver 305 in accordance with a result of the execution so as to control respective operations of the driving sections. The CPU 301 executes the program so that the sections shown in FIG. 4, which are other than the driving sections and will be described hereinafter, function and operate as the respective sections.

Figure 4:
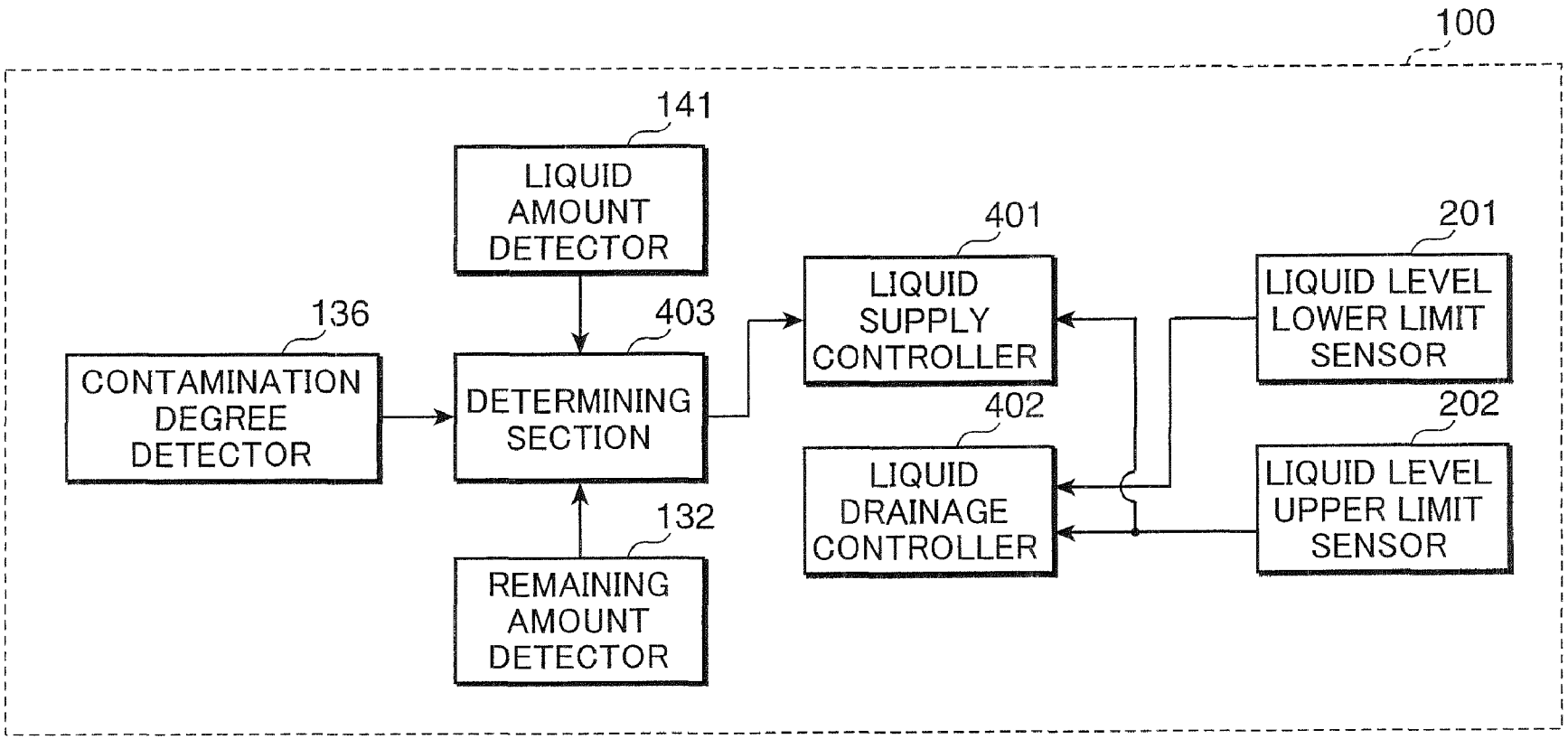
FIG. 4 is a block diagram schematically showing functions of relevant parts of the inkjet recording apparatus in accordance with an embodiment of the present invention.

FIG. 4 is a block diagram schematically showing functions of relevant parts of the inkjet recording apparatus in accordance with the first embodiment of the present invention. As shown in FIG. 4, the inkjet recording apparatus 100 includes a liquid supply controller 401 for controlling opening and closing of the liquid supply valve 133 (the liquid supply controller 401 constitutes a part of the liquid supplying section 151, and the same applies to each liquid supply controller described herebelow) and a liquid drainage controller 402 for controlling opening and closing of the liquid draining valve 138 (the liquid drainage controller 402 constitutes a part of the liquid draining section 152, and the same applies to each liquid drainage controller described herebelow). Further, the liquid drainage controller 402 receives outputs from the liquid level lower limit sensor 201 and the liquid level upper limit sensor 202. Further, the liquid supply controller 401 also receives the output from the liquid level upper limit sensor 202.

Further, the inkjet recording apparatus 100 includes a determining controller 403 (the determining section 403 constitutes respective parts of the liquid supplying section 151 and the liquid draining section 152, and the same applies hereinafter) which compares an ink contamination degree detected by the contamination degree detector 136 with a predetermined threshold value (for example, the threshold value is stored in the storage section or the like) and transmits an operation signal to the liquid supply controller 401 and the liquid drainage controller 402 in accordance with a comparison result. The determining section 403 compares an ink contamination degree obtained from the contamination degree detector 136 with the pre-registered threshold value. Here, the threshold value corresponds to an upper limit value of the ink contamination degree which permits continuous use of cleaning liquid in a current state. Thus, the determining section 403 determines that ink contamination degree of cleaning liquid is not abnormal when the obtained ink contamination degree is equal to or lower than the threshold value. Further, determining section 403 determines that the ink contamination degree of cleaning liquid is abnormal when the obtained ink contamination degree is greater than the threshold value.

Figure 5:
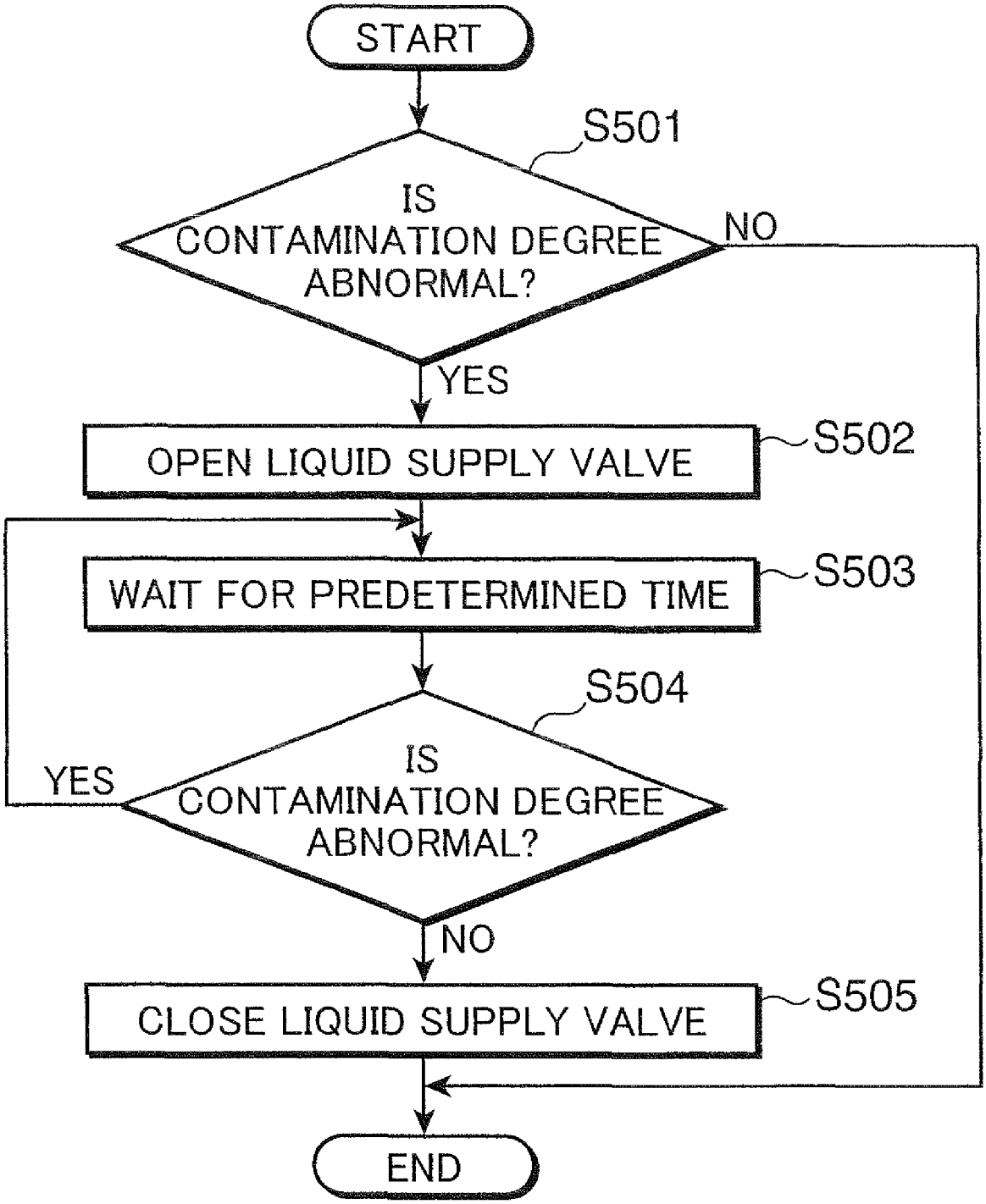
FIG. 5 is a flowchart showing a cleaning liquid monitoring processing in accordance with a first embodiment of the present invention.

FIG. 5 is a flowchart showing a cleaning liquid monitoring processing executed in the inkjet recording apparatus 100 in accordance with the first embodiment. The processing is repeated at predetermined time intervals during operation of the inkjet recording apparatus 100.

When the cleaning liquid monitoring processing is started, the determining section 403 obtains an ink contamination degree from the contamination degree detector 136. The determining section 403 compares the obtained ink contamination degree with the pre-registered threshold value (step S501). When the determining section 403 determines that the ink contamination degree of cleaning liquid is abnormal, it instructs the liquid supply controller 401 to supply new cleaning liquid (YES in step S501). After receiving the instruction, the liquid supply controller 401 changes a state of the liquid supply valve 133 from a closed state to an opened state (step S502). Accordingly, new cleaning liquid is supplied from the main tank 131 to the cleaning liquid storage section 135 (refer to FIGS. 1 and 2). When new cleaning liquid is supplied to the cleaning liquid storage section 135, a percentage of ink with respect to whole cleaning liquid in the cleaning liquid storage section 135 is reduced relatively. In other words, the ink contamination degree in cleaning liquid stored in the cleaning liquid storage section 135 becomes small.

After waiting for a predetermined time, the determining section 403 obtains an ink contamination degree from the contamination degree detector 136 again (steps S503, S504). At this time, when the determining section 403 determines that the ink contamination degree of cleaning liquid is not abnormal, it instructs the liquid supply controller 401 to stop the supply of cleaning liquid (NO in step S504). After receiving the instruction, the liquid supply controller 401 changes a state of the liquid supply valve 133 from the opened state to the closed state, and the cleaning liquid monitoring processing is terminated (step S505). On the other hand, when the determining section 403 determines that the ink contamination degree of cleaning liquid is abnormal (YES in step S504), it obtains an ink contamination degree from the contamination degree detector 136 again after waiting for a predetermined time (S503, S504). In other words, the supply of cleaning liquid from the main tank 131 is continued until the ink contamination degree becomes equal to or smaller than the threshold value.

In a course of the supply of cleaning liquid from the main tank 131, the amount of cleaning liquid in the cleaning liquid storage section 135 increases of course. In this case, when the liquid level upper limit sensor 202 detects a liquid level of cleaning liquid, the liquid drainage controller 402 changes a state of the liquid draining valve 138 from the closed state to the opened state in accordance with an output from the liquid level upper limit sensor 202. Accordingly, cleaning liquid is discharged from the cleaning liquid storage section 135. At this time, if a flow rate of cleaning liquid discharged through the liquid draining pipe 139 is smaller than a flow rate of cleaning liquid supplied to the cleaning liquid storage section 135 through the liquid supply pipe 134, the amount of cleaning liquid in the cleaning liquid storage section 135 increases. Therefore, in the present embodiment, the liquid supply controller 401 changes a state of the liquid supply valve 133 to the closed state for a predetermined time when the liquid supply controller 401 receives an output of the liquid level upper limit sensor 202. Thus, cleaning liquid does not overflow from the cleaning liquid storage section 135. Further, when the liquid level lower limit sensor 201 detects a liquid level of cleaning liquid, the liquid drainage controller 402 changes the state of the liquid drainage valve 138 from the opened state to the closed state in accordance with the output from the liquid level lower limit sensor 201. Further, when respective diameters of the liquid draining pipe 139 and the liquid supply pipe 134 are so designed that the flow rate of cleaning liquid discharged through the liquid draining pipe 139 becomes greater than the flow rate of cleaning liquid supplied to the cleaning liquid storage section 135 through the liquid supply pipe 134, it would not be necessary to stop the supply of cleaning liquid, so that shortening of time is possible.

When the cleaning liquid monitoring processing is started, and the determining section 403 determines that an ink contamination degree of cleaning liquid in the cleaning liquid storage section 135 is not abnormal, the cleaning liquid monitoring processing is terminated directly (NO in step S501).

Further, when the amount of waste liquid in the liquid drainage tank 140 increases, and the liquid amount detector 141 detects that the amount of waste liquid reaches the upper limit capacity, the liquid drainage controller 402 closes the liquid draining valve 138, and the liquid supply controller 401 closes the liquid supply valve 133. Then, necessity of replacement of the liquid drainage tank 140 is notified by means of displaying on a display portion of the inkjet recording apparatus 100 or by means of voice. Then, after replacement of the liquid drainage tank 140 is detected, the liquid supply controller 401 and the liquid drainage controller 402 open the liquid draining valve 138 and the liquid supply valve 133 respectively, and a control which had been performed before the liquid draining valve 138 and the liquid supply valve 133 are closed is performed continuously. At this time, the liquid supply controller 401 and the liquid drainage controller 402 perform closing and opening of the liquid draining valve 138 and the liquid supply valve 133 in accordance with a notification from the liquid amount detector 141.

According to this configuration, an ink contamination degree in cleaning liquid, to which the cleaning roller 137 is soaked, stored in the cleaning liquid storage section 135 can be detected directly without depending on a calculation based on a running time or a running length of the conveying belt 106. Therefore, the liquid supply controller 401 can supply new cleaning liquid to the cleaning liquid storage section 135 in accordance with a degree of contamination (ink) in cleaning liquid stored in the cleaning liquid storage section 135. Thus, the inkjet recording apparatus 100 can maintain an adequate cleaning ability without wastefully losing cleaning liquid, so that lowering in cleaning ability of the cleaning roller 137 can be prevented. As a result, the conveying belt 106 can be cleaned efficiently.

Second Embodiment

Meanwhile, when the conveying belt 106 is contaminated suddenly due to occurrence of sheet jamming or the like, the ink contamination degree of cleaning liquid rises drastically in the cleaning liquid storage section 135. In this case, according to the configuration of the first embodiment, cleaning liquid is supplied from the main tank 131 continuously for a long time. As described above, when the ink contamination degree of cleaning liquid in the cleaning liquid storage section 135 is high, ink in cleaning liquid may adhere to the cleaning roller 137 and thereafter adhere to the cleaning belt 106 through the cleaning roller 137. Thus, when the ink contamination degree of cleaning liquid rises drastically, it is preferable that the ink contamination degree is reduced quickly in response to this. In the present embodiment, a control of reducing the ink contamination degree quickly is performed in the case where a drastic rise in the ink contamination degree of cleaning liquid occurs suddenly.

Figure 6:
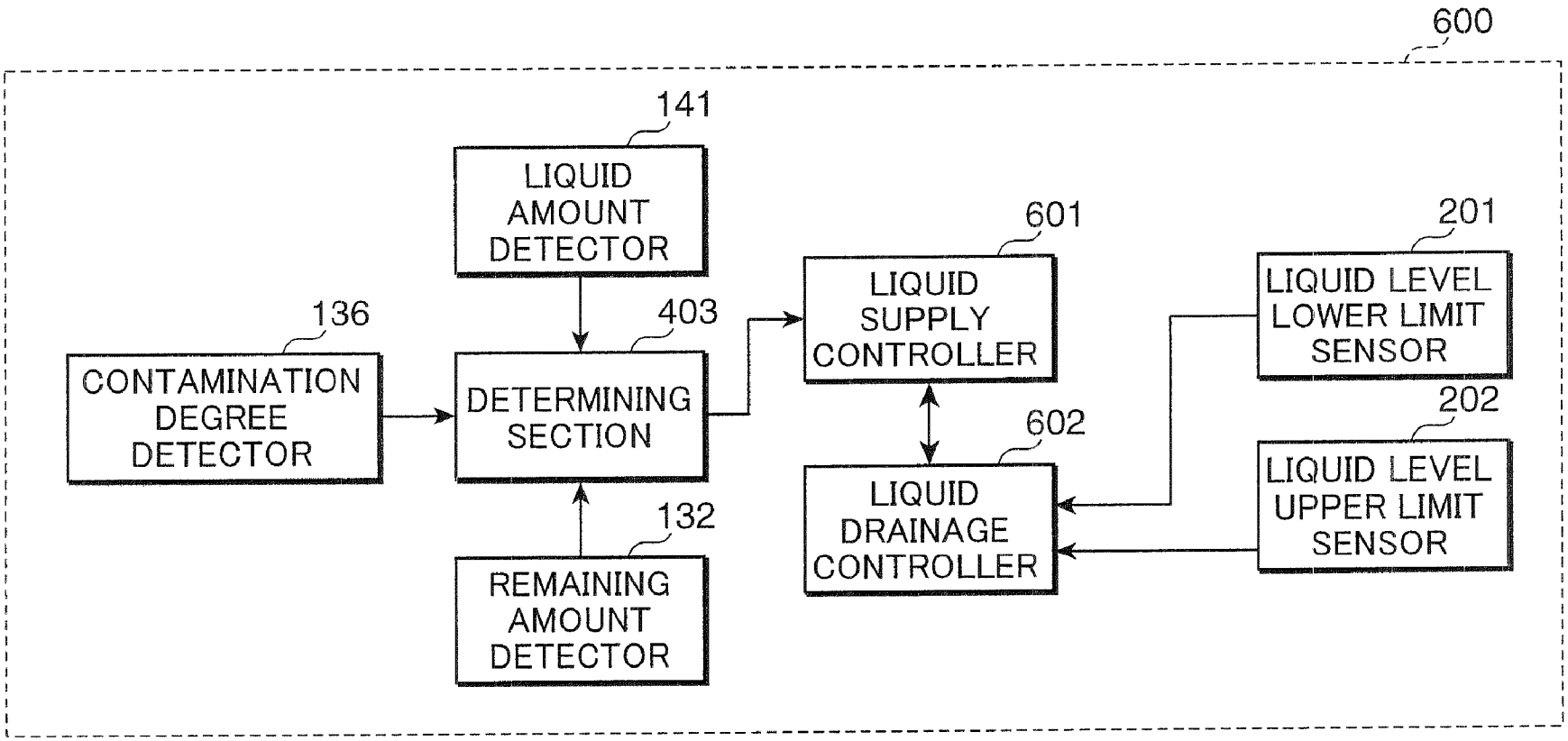
FIG. 6 is a block diagram schematically showing functions of relevant parts of an inkjet recording apparatus in accordance with a second embodiment of the present invention.

FIG. 6 is a block diagram schematically showing functions of relevant parts of an inkjet recording apparatus in accordance with a second embodiment of the present invention. An inkjet recording apparatus 600 in accordance with the present embodiment is different from that in accordance with the first embodiment on the point that the liquid supply valve 133 and the liquid draining valve 138 shown in FIG. 1 and FIG. 2 are electromagnetic valves which are so configured that their opening degrees are adjustable. In the present embodiment, electromagnetic valves which are capable of setting a plurality of opening degrees are used as the liquid supply valve 133 and the liquid draining valve 138. In other words, in the second embodiment, degrees of opening of the liquid supply valve 133 and the liquid draining valve 138 are adjustable, so that the flow rate of liquid passing through the liquid supply valve 133 of the liquid supply pipe 134 and the liquid draining valve 138 of the liquid draining pipe 139 can be adjusted.

As shown in FIG. 6, the inkjet recording apparatus 600 is provided with a liquid supply controller 601 for controlling an opening degree of the liquid supply valve 133 (a degree of opening of the liquid supply valve 133) and a liquid drainage controller 602 for controlling an opening degree of the liquid draining valve 138 (a degree of opening of the liquid draining valve 138). Further, the liquid drainage controller 602 receives outputs from both the liquid level lower limit sensor 201 and the liquid level upper limit sensor 202. Other configurations and those of the control system will be omitted from description since configurations are the same as those of the inkjet recording apparatus 100 in accordance with the first embodiment.

Figure 7:
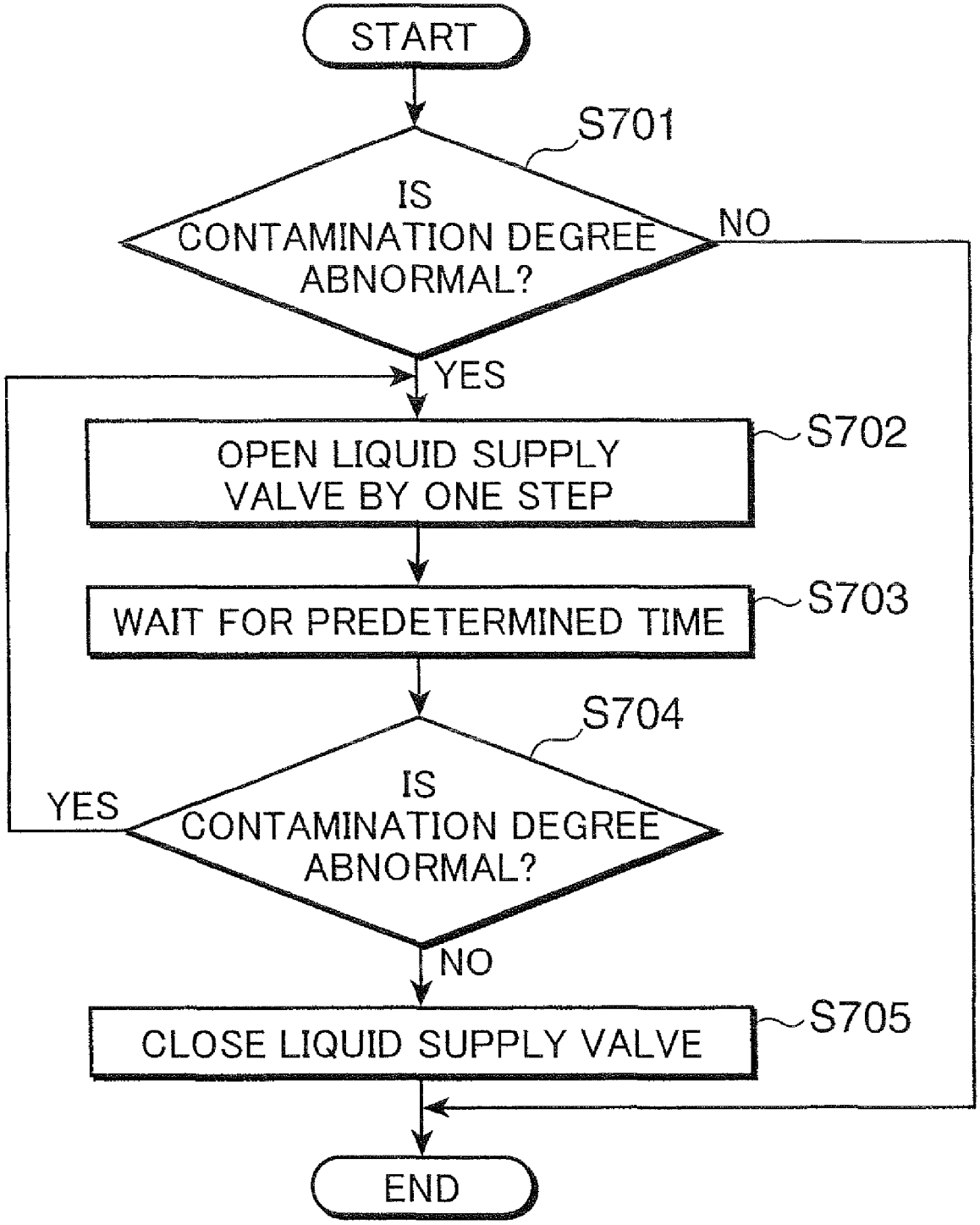
FIG. 7 is a flowchart showing a cleaning liquid monitoring processing in accordance with the second embodiment of the present invention.

FIG. 7 is a flowchart showing a cleaning liquid monitoring processing of the inkjet recording apparatus 600. The processing is repeatedly performed at predetermined time intervals during operation of the inkjet recording apparatus 600.

When the cleaning liquid monitoring processing is started, the determining section 403 obtains an ink contamination degree from the contamination degree detector 136. The determining section 403 compares the obtained ink contamination degree with a pre-registered threshold value (step S701). When the determining section 403 determines that ink contamination degree of cleaning liquid is abnormal, it instructs a liquid supply controller 601 to supply cleaning liquid (YES in step S701). After receiving the instruction, the liquid supply controller 601 opens the liquid supply valve 133 by one step from the closed state (step S702). In other words, the liquid supply controller 601 sets a passing rate of cleaning liquid through the liquid supply valve 133 of the liquid supply pipe 134 to be a rate of a predetermined first step. Accordingly, new cleaning liquid is supplied from the main tank 131 to the cleaning liquid storage section 135, so that a percentage of ink with respect to whole cleaning liquid reduces relatively, and the ink contamination degree becomes small (refer to FIGS. 1 and 2).

After waiting for a predetermined time, the determining section 403 obtains an ink contamination degree from the contamination degree detector 136 again (step S703, S704). At this time, when the determining section 403 determines that the ink contamination degree of cleaning liquid is not abnormal, it instructs the liquid supply controller 601 to stop supply of cleaning liquid (NO in step S704). After receiving the instruction, the liquid supply controller 601 changes a state of the liquid supply valve 133 to be the closed state, and the cleaning liquid monitoring processing is terminated (step S705).

Further, when the determining section 403 determines that the ink contamination degree of cleaning liquid is abnormal, it instructs the liquid supply controller 601 to increase the supply rate of cleaning liquid (YES in step S704). After receiving the instruction, the liquid supply controller 601 further opens the liquid supply valve 133 by one step (step S702). In other words, the liquid supply controller 601 sets the cleaning liquid passing rate at the liquid supply valve 133 of the liquid supply pipe 134 to be a predetermined second rate which is greater than the rate in the first step. This causes the supply rate of new cleaning liquid supplied from the main tank 131 to the cleaning liquid storage section 135 to be greater than the previous supply rate. Therefore, a rate of lowering the ink contamination degree in the cleaning liquid storage section 135 increases.

Then, after waiting for a predetermined time, the determining section 403 obtains an ink contamination degree from the contamination degree detector 136 again (step S703, S704). When the determining section 403 determines that the ink contamination degree of cleaning liquid is still abnormal also at this point of time, it instructs the liquid supply controller 601 to increase the supply rate of cleaning liquid (YES in step S704). After receiving the instruction, the liquid supply controller 601 further opens the liquid supply valve 133 by one step (step S702). In other words, the liquid supply controller 601 sets the cleaning liquid passing rate at the liquid supply valve 133 of the liquid supply pipe 134 to be a predetermined third rate which is greater than the rate in the second step. As described above, the determining section 403 repeatedly executes the processing of S702 through S704 until the ink contamination degree of cleaning liquid becomes normal (sequentially increases the steps of the cleaning liquid passing rate at each time of detecting abnormality). In other words, when the ink contamination degree does not become equal to or lower than the threshold value even by the supply of cleaning liquid from the main tank 131, the determining section 403 executes the processing of gradually increasing the supply rate of cleaning liquid from the main tank 131. When the opening degree of the liquid supply valve 133 reaches maximum in step S702 (when the cleaning liquid passing rate reaches a predetermined maximum step), the determining section 403 keeps the maximum opening degree in processing of S702 through S704.

Similarly to the first embodiment, the amount of cleaning liquid in the cleaning liquid storage section 135 increases necessarily in a course of the supply of cleaning liquid from the main tank 131. In this case, when liquid level upper limit sensor 202 detects a liquid level of cleaning liquid, the liquid drainage controller 602 changes the state of the liquid draining valve 138 from the closed state to the opened state. In the present embodiment, the liquid drainage controller 602 obtains an opening degree of the liquid supply valve 133 from the liquid supply controller 601 when it changes the state of the liquid draining valve 138 to be the opened state. Then, the liquid drainage controller 602 sets an opening degree of the liquid draining valve 138 so that the flow rate of cleaning liquid discharged through the liquid draining pipe 139 becomes greater than the flow rate of cleaning liquid supplied to the cleaning liquid storage section 135 through the liquid supply pipe 134. Thus, cleaning liquid does not overflow from the cleaning liquid storage section 135. The liquid drainage controller 602 changes the state of the liquid draining valve 138 to the closed state when the liquid level lower limit sensor 201 detects a liquid level of cleaning liquid.

When the cleaning liquid monitoring processing started, and the determining section 403 determines that the ink contamination degree of cleaning liquid is not abnormal, the cleaning liquid monitoring processing is terminated directly (NO in step S701).

Here, when the amount of waste liquid in the liquid drainage tank 140 increases, and the liquid amount detector 141 detects that the amount of waste liquid reaches an upper limit capacity, the liquid supply controller 601 and the liquid drainage controller 602 closes the liquid supply valve 133 and the liquid draining valve 138, and the liquid amount detector 141 outputs a signal indicating the detection signal to the determining section 403, and then the determining section 403 allows the display portion of the inkjet recording apparatus 600 to notify by display or sound that replacement of the liquid drainage tank 140 is necessary. Then, after replacement of the liquid drainage tank 140 is detected, the liquid supply controller 601 and the liquid drainage controller 602 opens the liquid supply valve 133 and the liquid draining valve 138 at opening degrees which were set before closing, and the control which had been executed previously before the liquid supply valve 133 and the liquid draining valve 138 are closed is executed continuously. At this time, the liquid supply controller 601 and the liquid drainage controller 602 closes or opens the liquid supply valve 133 and the liquid draining valve 138 respectively in accordance with a notification from the liquid amount detector 141.

According to this configuration, when the ink contamination degree does not become equal to or lower than the threshold value even through cleaning liquid is supplied from the main tank 131, the supply rate of cleaning liquid from the main tank 131 can be increased gradually. Therefore, when the ink contamination degree of cleaning liquid gradually increases in a normal state of use, the supply rate of cleaning liquid from the main tank 131 is small. Further, when the ink contamination degree of cleaning liquid rises suddenly, the supply rate of cleaning liquid increases gradually. Therefore, even when the ink contamination degree of cleaning liquid rises suddenly, the ink contamination degree can be lowered quickly.

Further, also in the second embodiment, the ink contamination degree of cleaning liquid stored in the cleaning liquid storage section 135 to which the cleaning roller is soaked is directly detected, similarly to the first embodiment. Therefore, new cleaning liquid can be supplied to the cleaning liquid storage section 135 accurately in accordance with a contamination degree of cleaning liquid stored in the cleaning liquid storage section 135, so that lowering of cleaning ability of the cleaning roller can be prevented. Further, the cleaning belt can be cleaned efficiently without wastefully losing cleaning liquid.

In the present embodiment, a control of increasing the opening degree of the liquid supply valve 133 by predetermined steps is shown. However, in place of this, the determining section 403 may be so configured as to calculate the amount of change in the ink contamination degree before and after changing of the opening degree of the liquid supply valve 133 so that the liquid supply controller 601 sets an opening degree associated with the amount of change in the opening degree of the liquid supply valve 133 in accordance with change in ink contamination degree (the liquid supply controller 601 may calculate the opening degree from the change in ink contamination degree, or may read from a table storing value data of opening degree of the liquid supply valve 133 associated with the change in ink contamination degree). It may be so configured that a valve capable of setting any opening degree is adopted in the liquid supply valve 133.

Further, in the configuration described above, when the determining section 403 determines that the ink contamination degree is abnormal in a state where an opening degree of the liquid supply valve 133 is at maximum, the liquid supply controller 601 supplies cleaning liquid while maintaining the opening degree of the liquid supply valve 133 to be at maximum. However, when the ink contamination degree of cleaning liquid in the cleaning liquid storage section 135 rises drastically in such state, ink in cleaning liquid may be adhered to the conveying belt through the cleaning roller 137. Therefore, a configuration may be adopted in which the determining section 403 allows the alarming section to give alarm to notify a user to replace all of cleaning liquid in the cleaning liquid storage section 135 when the opening degree of the liquid supply valve 133 is at maximum, and the ink contamination degree is over the threshold value.

Further, when the contamination degree detector 136 detects that the ink contamination degree drastically rises over the threshold value, the controller 300 may allow the image forming section including the recording head 107, the conveying belt 106, the driving roller 121, the pair of registration rollers 105, and the conveying roller 103 to suspend image forming operation and stop the conveying belt 106, and thereafter may allow an unillustrated cleaning roller driving mechanism to perform an operation of allowing the cleaning roller 137 to be separated from the conveying belt 106. This may prevent ink contained in the cleaning liquid storage section 135 from being adhered to the conveying belt 106. Such modification of the inkjet recording apparatus 600 will be described with reference to FIG. 8 hereinafter.

Figure 8:
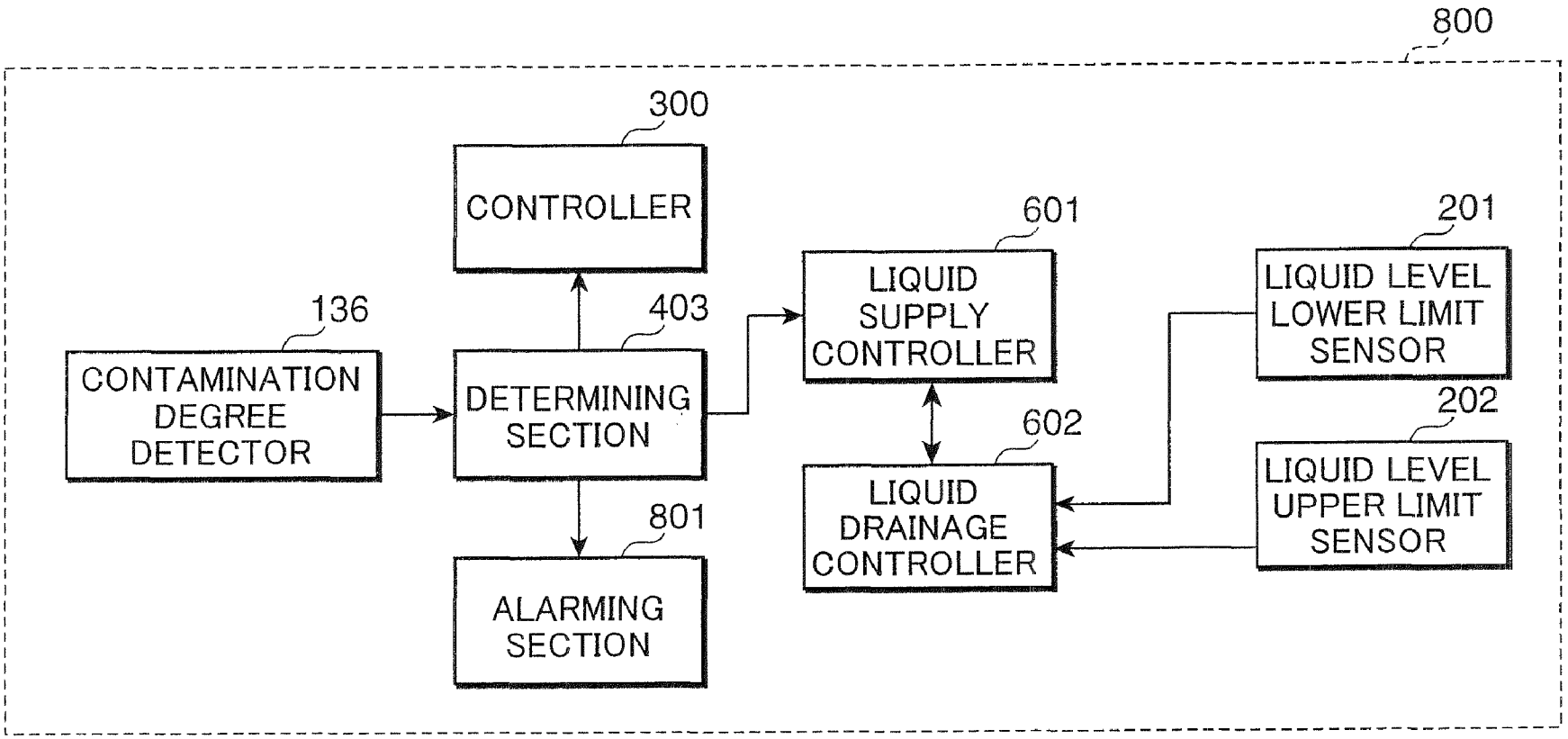
FIG. 8 is a block diagram schematically showing functions of relevant parts of a modified example of the inkjet recording apparatus in accordance with the second embodiment of the present invention.

FIG. 8 is a block diagram schematically showing functions of a modified example of an inkjet recording apparatus in accordance with the present embodiment. As shown in FIG. 8, an inkjet recording apparatus 800 includes an alarming section 801 in addition to the configuration shown in FIG. 6. The alarming section 801 gives an alarm in any method such as displaying of notification and a sound which can be noticed by a user in accordance with an instruction given by the determining section 403.

Figure 9:
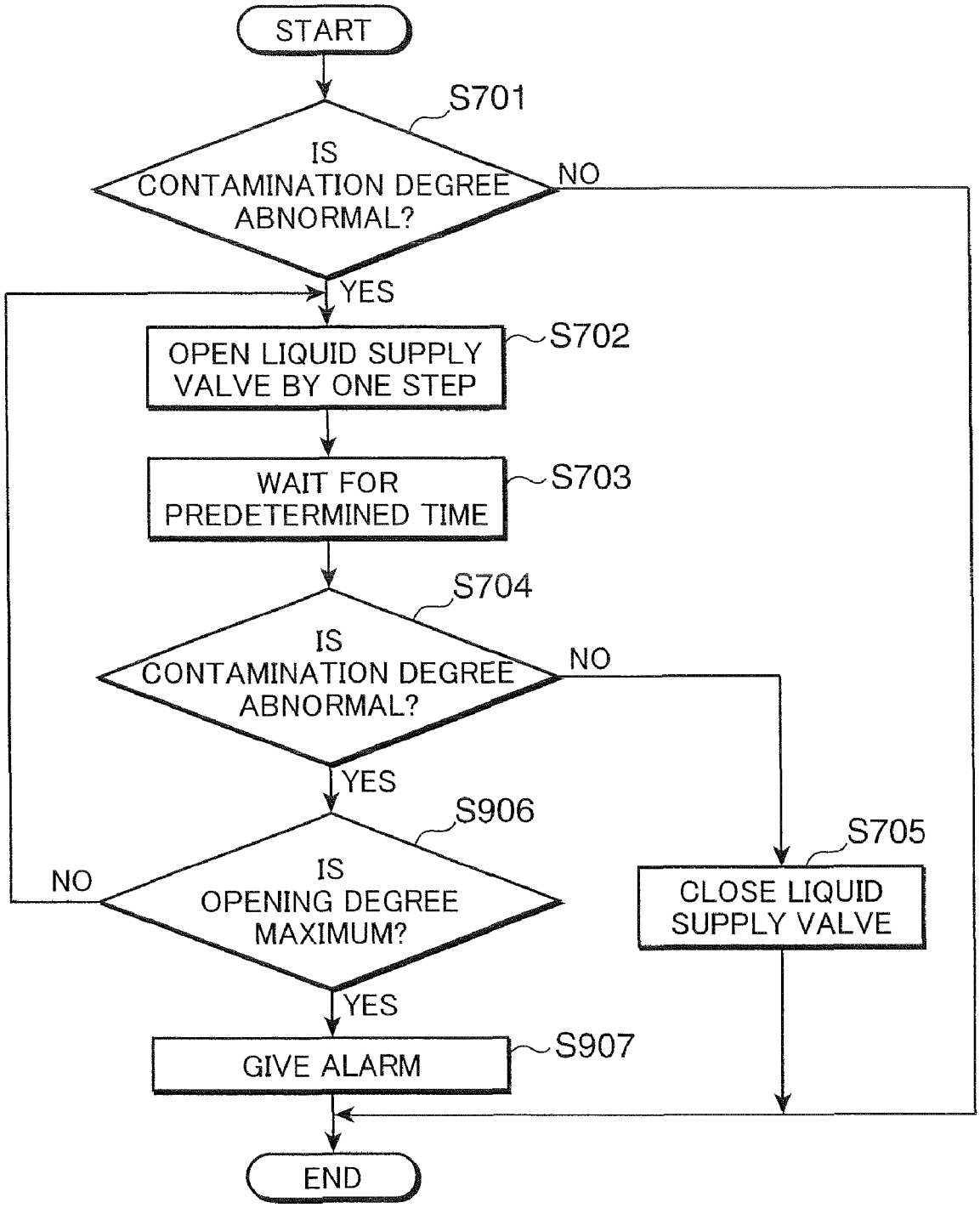
FIG. 9 is a flowchart showing a modified example of the cleaning liquid monitoring processing in accordance with the second embodiment of the present invention.

FIG. 9 is a flowchart showing a cleaning liquid monitoring processing of the inkjet recording apparatus 800. The flowchart is almost the same as the flowchart shown in FIG. 7. Therefore, the processing which have been already described with reference to FIG. 7 will be identified with the same reference numerals, and description of those will be omitted.

As shown in FIG. 9, in the inkjet recording apparatus 800, when the liquid supply valve 133 is opened by one step, and the determining section 403 determines that the ink contamination degree of cleaning liquid is abnormal, the determining section 403 instructs the liquid supply controller 601 to increase the supply rate of cleaning liquid (YES in step S704). After receiving the instruction, the liquid supply controller 601 confirms if the opening degree of the liquid supply valve 133 is at maximum (step S906). When the opening degree of the liquid supply valve 133 is not at maximum, the liquid supply controller 601 further opens the liquid supply valve 133 by one step (NO in step S906, S702). On the other hand, when the opening degree of the liquid supply valve 133 is at maximum, the liquid supply controller 601 notifies it to the determining section 403 (YES in step S906). At this time, the determining section 402 instructs the alarming section 801 to give an alarm, and instructs the controller 300, which drives the pair of registration rollers 105 and the pair of conveying rollers 103, to stop conveying of the sheet P (step S907).

A user who confirms the alarm can manually make operations of discharging all of cleaning liquid stored in the cleaning liquid storage section 135 and filling the cleaning liquid storage section 135 with new cleaning liquid.

According to this configuration, when the ink contamination degree of cleaning liquid in the cleaning liquid storage section 135 rises drastically in a state where the opening degree of the liquid supply valve 133 is at maximum, conveying of the sheet P is stopped, a user is notified to replace cleaning liquid. Therefore, contamination of the sheet P can be prevented from occurring assuredly.

Third Embodiment

In the second embodiment, it is so configured that the alarming section 801 gives an alarm to notify a user to replace cleaning liquid. However, in the present embodiment, a configuration will be described which automatically perform replacement of cleaning liquid.

Figure 10:
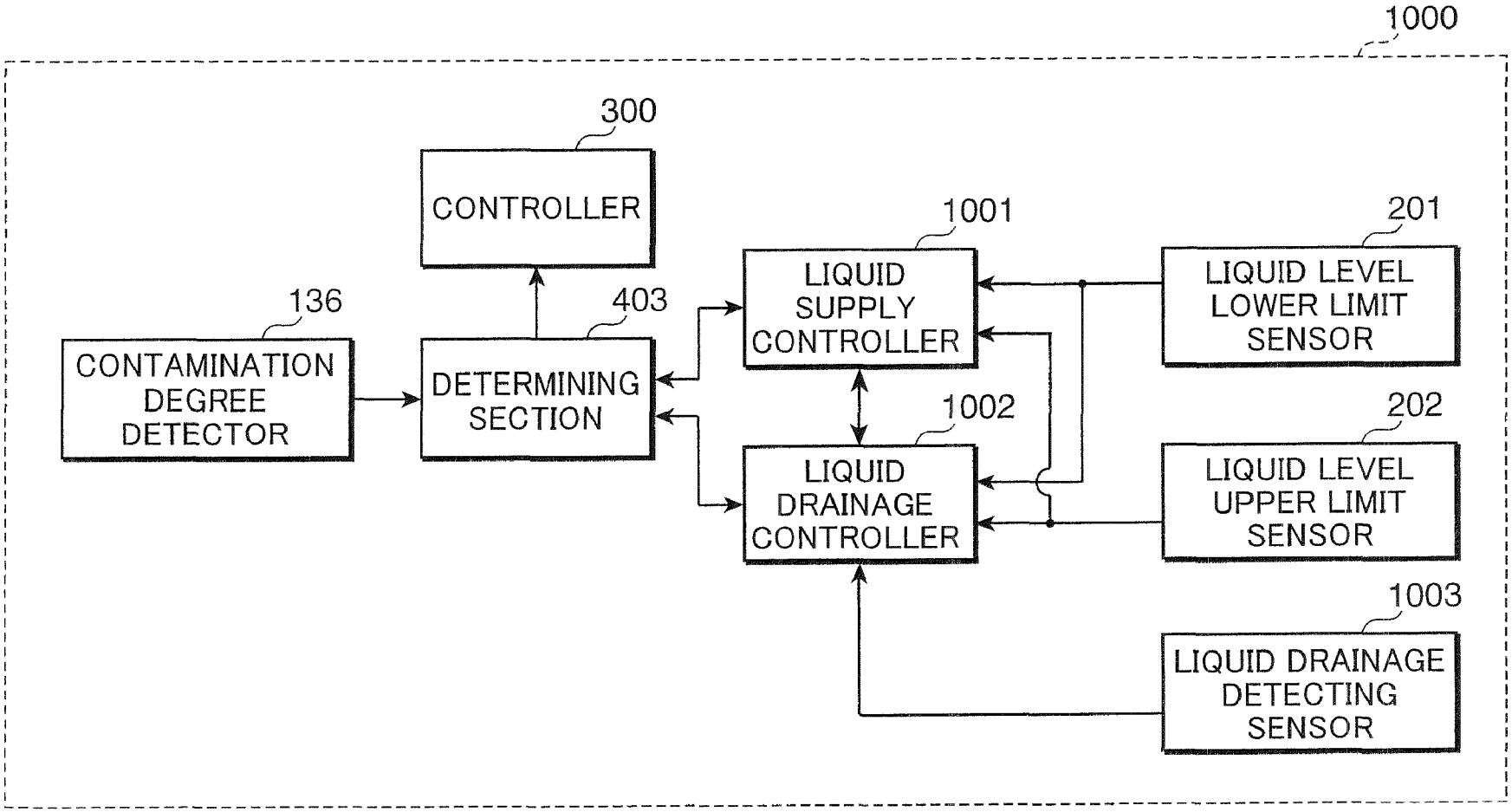
FIG. 10 is a block diagram schematically showing functions of relevant parts of an inkjet recording apparatus in accordance with a third embodiment of the present invention.

FIG. 10 is a block diagram schematically showing functions of an inkjet recording apparatus in accordance with the present embodiment. As shown in FIG. 10, an inkjet recording apparatus 1000 is provided with a liquid supply controller 1001 for controlling the opening degree of the liquid supply valve 133 and a liquid drainage controller 1002 for controlling the opening degree of the liquid draining valve 138, similarly to the inkjet recording apparatus 600 in accordance with the second embodiment. Further, the liquid supply controller 1001 and the liquid drainage controller 1002 receives outputs of the liquid level lower limit sensor 201 and the liquid level upper limit sensor 202, respectively.

Figure 11:
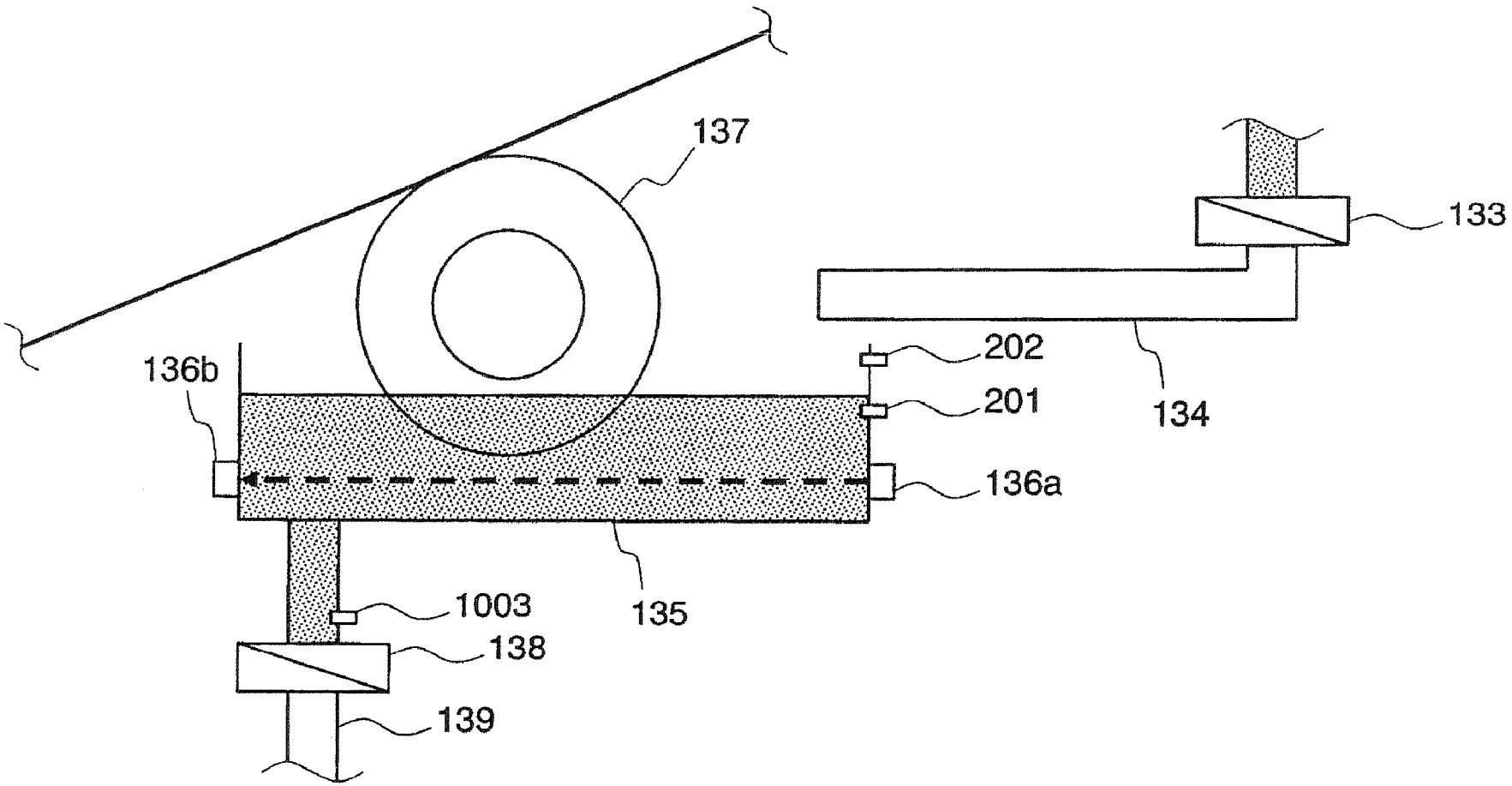
FIG. 11 is an enlarged view showing configurations of relevant parts of the inkjet recording apparatus in accordance with the third embodiment of the present invention.

Further, the inkjet recording apparatus 1000 is provided with a drainage detection sensor 1003. As shown in an enlarged view of FIG. 11, the drainage detection sensor 1003 is provided in the liquid drainage pipe 139 at a position closer to the side of the cleaning liquid storage section 135 than the liquid draining valve 138 and is adapted to detect that cleaning liquid is discharged from the cleaning liquid storage section 135. The liquid drainage controller 1002 receives an output of the drainage detection sensor 1003.

Figure 12:
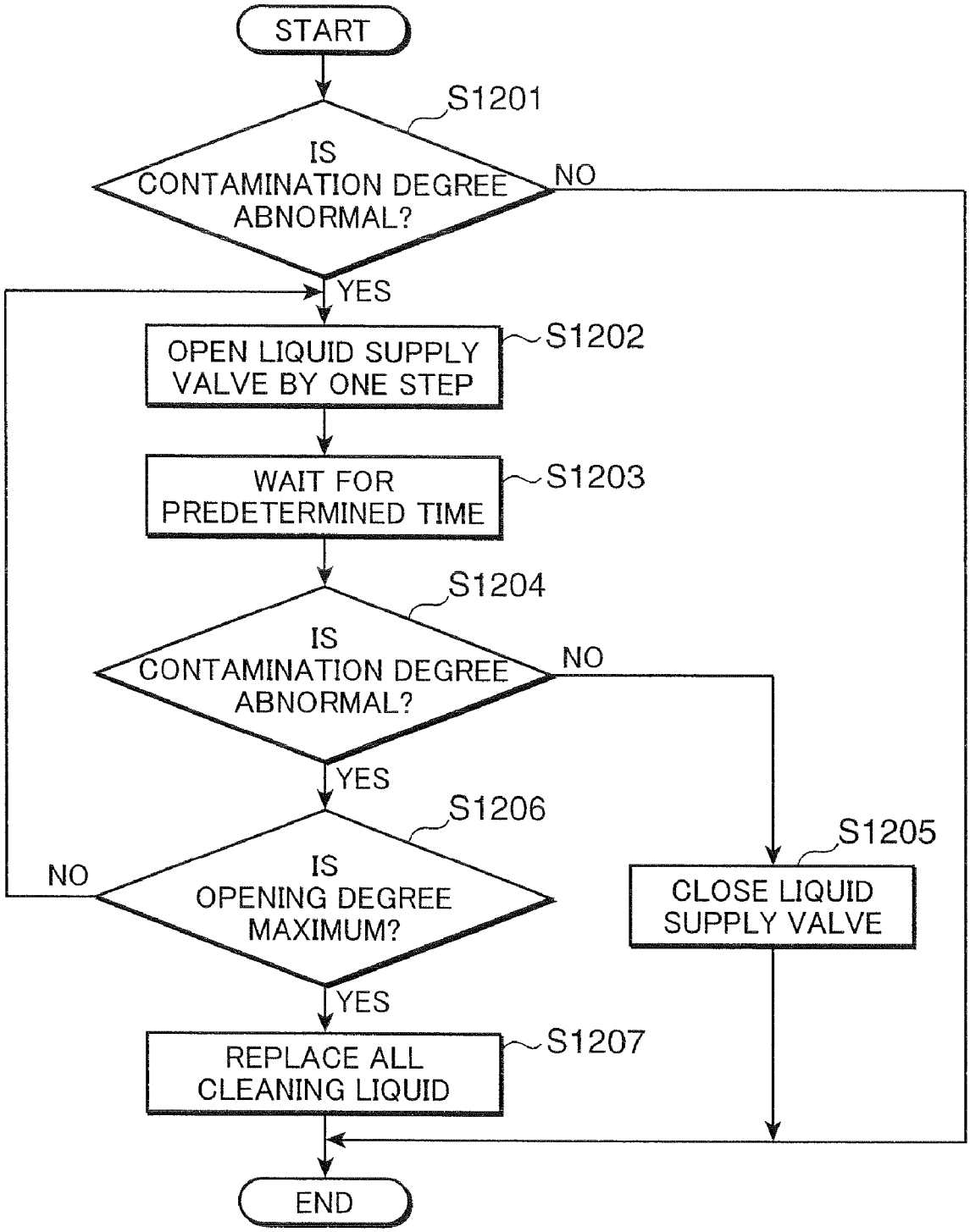
FIG. 12 is a flowchart showing a cleaning liquid monitoring processing in accordance with the third embodiment of the present invention.

FIG. 12 is a flowchart showing a cleaning liquid monitoring processing of the inkjet recording apparatus 1000. The processing is repeatedly executed at predetermined time intervals during operation of the inkjet recording apparatus 1000.

When the cleaning liquid monitoring processing is started, the determining section 403 obtains an ink contamination degree from a contamination degree detector 136. The determining section 403 compares the obtained ink contamination degree with a pre-registered threshold value (step S1201). When the determining section 403 determines that the ink contamination degree of cleaning liquid is abnormal, it instructs the liquid supply controller 1001 to supply cleaning liquid (YES in step S1201). After receiving the instruction, the liquid supply controller 1001 opens the liquid supply valve 133 from the closed state by one step (step S1202). Accordingly, new cleaning liquid is supplied from the main tank 131 to the cleaning liquid storage section 135 (refer to FIGS. 1 and 2). When new cleaning liquid supplied to the cleaning liquid storage section 135, a percentage of ink with respect to whole cleaning liquid is reduced, so that ink contamination degree becomes small.

After waiting for a predetermined time, the determining section 403 obtains the ink contamination degree from the contamination degree detector 136 again (step S1203, S1204). At this time, when the determining section 403 determines that the ink contamination degree of cleaning liquid is not abnormal, it instructs the liquid supply controller 1001 to stop the supply of cleaning liquid (NO in step S1204). After receiving the instruction, the liquid supply controller 1001 changes the state of the liquid supply valve 133 to the closed state, and the cleaning liquid monitoring processing is terminated (step S1205). Further, when the determining section 403 determines that the ink contamination degree of cleaning liquid is abnormal, it instructs the liquid supply controller 1001 to increase the supply rate of cleaning liquid (YES in step S1204). After receiving the instruction, the liquid supply controller 1001 detects whether or not the opening degree of the liquid supply valve 133 is at maximum (step S1206). When the opening degree of the liquid supply valve 133 is not at maximum, the liquid supply controller 1001 further opens the liquid supply valve 133 by one step (NO in step S1206, S1202). Accordingly, the amount of cleaning liquid supplied from the main tank 131 to the cleaning liquid storage section 135 increases, so that a rate of lowering the ink contamination degree increases in the cleaning liquid storage section 135.

On the other hand, when the opening degree of the liquid supply valve 133 becomes at maximum as a result of repeated execution of step S11202 through step S1205, the liquid supply controller 1001 notifies it to the determining section 403 (YES in step S1206). At this time, the determining section 403 instructs the liquid supply controller 1001 and the liquid drainage controller 1002 to replace cleaning liquid in the cleaning liquid storage section 135, and instructs the controller 300 (refer to FIG. 10) for controlling driving of the image forming section including the pair of registration rollers 105 and the pair of driving rollers 103 to stop conveying the sheet P (step S1207). In other words, at this time, the liquid supply controller 1001 closes the liquid supply valve 133 and notifies it to the liquid drainage controller 1002 at a time of completion of closing. After receiving the notification, the liquid drainage controller 1002 opens the liquid draining valve 138 at a maximum opening degree. When a signal indicating that draining of liquid is completed is inputted to the liquid drainage controller 1002 by the drainage detection sensor 1003, the liquid drainage controller 1002 closes the liquid draining valve 138 and notifies it to the liquid supply controller 1001 at a time of completion of closing. After receiving the notification, the liquid supply controller 1001 opens the liquid supply valve 133 at a maximum opening degree. Then, when a signal indicating that a liquid level of cleaning liquid is inputted to the liquid supply controller 1001 by the liquid level lower limit sensor 201 (or the liquid level upper limit sensor 202), the liquid supply valve 133 is closed. Accordingly, replacement of cleaning liquid in the cleaning liquid storage section 135 is completed. When the liquid supply controller 1001 closes the liquid supply valve 133 in accordance with the signal inputted by the liquid level lower limit sensor 201 (or the liquid level upper limit sensor 202), it is notified to the determining section 403. After receiving the notification, the determining section 403 instructs the controller 300 for controlling driving of the image forming section including the pair of registration rollers 105 and the pair of driving rollers 103 to restart conveying of the sheet P.

Here, when the amount of waste liquid in the liquid drainage tank 140 increases, and the liquid amount detector 141 detects waste liquid, the liquid drainage controller 1002 and the liquid supply controller 1001 close the liquid draining valve 138 and the liquid supply valve 133 respectively, the determining section 403 allows the display portion (for example, the alarming section 801 shown in FIG. 8) of the inkjet recording apparatus 1000 to notify by displaying or a voice that replacement of the liquid drainage tank 140 is necessary. Then, after replacement of the liquid drainage tank 140 is detected (for example, by the determining section 403), the liquid drainage controller 1002 and the liquid supply controller 1001 open the liquid draining valve 138 and the liquid supply valve 133 at opening degrees which had been set before closing and continuously performs the control which had been performed before closing of the liquid draining valve 138 and the liquid supply valve 133. At this time, the liquid drainage controller 1002 and the liquid supply controller 1001 perform closing and opening of the liquid drainage valve 138 and the liquid supply valve 133 respectively in accordance with the notification inputted by the liquid amount detector 141.

When the cleaning liquid monitoring processing is started, and the determining section 403 determines that the ink contamination degree of cleaning liquid is not abnormal, the cleaning liquid monitoring processing is terminated directly (NO in step S1201).

According to this configuration, when the ink contamination degree of cleaning liquid in the cleaning liquid storage section 135 in a state where the opening degree of the liquid supply valve 133 is at maximum, conveying of the sheet P is stopped, and cleaning liquid is replaced automatically. Therefore, contamination of the sheet P is prevented from occurring. Other effects are the same as those of the second embodiment.

In each of the embodiments described above, the state where the ink contamination degree is greater than the threshold value corresponds to the state where the output voltage of the contamination degree detector 136 becomes smaller than a predetermined value corresponding to the threshold value, and the state where the ink contamination degree is equal to or smaller than the threshold value corresponds to the state where the output voltage of the contamination degree detector 136 becomes equal to or greater than a predetermined voltage corresponding to the threshold value. Thus, the determining section 403 can detect abnormality of the ink contamination degree of cleaning liquid by comparing the output voltage of the contamination degree detector 136 with the predetermined voltage corresponding to the threshold value.

As described above, according to the present invention, even in the case where jamming of a recording sheet or deformation of the recording medium occurs during conveying of the recording medium, a situation where cleaning liquid still having sufficient cleaning ability is replaced and a situation where cleaning liquid including a large amount of ink is not replaced can be prevented from occurring. Thus, the conveying belt can be cleaned efficiently. Therefore, image forming can be performed without contaminating a recording medium in contact with the surface of the conveying belt 106 with ink. In a case of successively performing a processing of forming an image by discharging ink from the inkjet recording head 107 onto a whole area of a recording medium without providing an outer edge, the belt surface is susceptible to be contaminated with ink which is discharged onto the belt surface which is outer than the edge of the recording medium. However, the present invention is effective in the case where such image forming processing is performed.

The embodiments described above do not limit the technological scope of the invention, and it may be modified in various ways and applied within a range of the present invention, even if it is other than the ones which are already described above. For example, according to the description above, the light emitting section 136*a* and the light receiver 136*b* of the contamination degree detector 136 are arranged on the facing side surfaces of the cleaning liquid storage section 135. However, one may be arranged on the bottom surface of the cleaning liquid storage section 135, and the other may be so arranged as to face at a position above the cleaning liquid storage section 135. Further, the contamination degree detector 136 is not limited to the transmission type light sensor, and any configuration may be adopted as long as it can detect the amount of ink contaminating the liquid (contamination degree).

Further, in each of the embodiments described above, opening and closing of the liquid supply valve and the liquid draining valve are controlled by the liquid drainage controller and the liquid supply controller for the supply and discharging of cleaning liquid. However, in place of the valves, flow rate controlling pumps may be adopted to achieve the similar effect.

Further, a part of the cleaning roller 137 is soaked in cleaning liquid stored in the cleaning liquid storage section 135. However, it may be so configured that the cleaning roller 137 is not soaked in cleaning liquid stored in the cleaning liquid storage section 135. In other words, the following configuration may be adopted. It may be so configured that the cleaning roller 137 is arranged above a liquid level of cleaning liquid stored in the cleaning liquid storage section 135. In this case, cleaning liquid stored in the cleaning liquid storage section 135 is pumped up with the pump and dropped onto the cleaning roller 137. Then, a squeezing roller comes in contact with the cleaning roller 137 after cleaning the conveying belt 106, and used cleaning liquid is squeezed from the cleaning roller 137 and drops into the cleaning liquid storage section 135.

Further, a stirring section for stirring cleaning liquid may be provided in the cleaning liquid storage section 135, so that unused cleaning liquid which is refilled from the main tank 131 to the cleaning liquid storage section 135 and cleaning liquid contaminated by ink in the cleaning liquid storage section 135 may be mixed in an evenly dispersed state by stirring. Continuous driving of the stirring section during the inkjet recording apparatus is not stopped allows ink contaminating to the cleaning liquid to be evenly dispersed, so that misdetection of the contamination degree detector 136 due to unevenness in the ink contamination degree of cleaning liquid can be prevented.

Further, according to each of the embodiments, the contamination degree detector 136 detects the ink contamination degree of cleaning liquid in the cleaning liquid storage section 135 as the density of contamination. However, the contamination degree detector 136 may detect the density by detecting contamination due to ink, paper debris, dusts and the like included in the cleaning liquid, and the liquid supplying section 151 may control the supply of cleaning liquid to the cleaning liquid storage section 135 in accordance with a density of contamination detected by the contamination degree detector 136.

The present invention has an effect of cleaning a conveying belt efficiently, and is useful as an inkjet recording apparatus.

In summary, according to an aspect of the present invention, an inkjet recording apparatus which discharges ink onto a recording medium to form an image comprises: a recording head having a nozzle for discharging ink; a conveying belt for supporting a recording medium and conveying the recording medium to a position facing the nozzle; a cleaning roller for cleaning the conveying belt; a cleaning liquid storage section for storing cleaning liquid to be applied to the cleaning roller; a contamination detector for detecting a density of contamination of the cleaning liquid stored in the cleaning liquid storage section; a liquid supplying section for controlling supply of cleaning liquid to the cleaning liquid storage section in accordance with a density of contamination detected by the contamination detector; and a liquid draining section for draining at least a part of the cleaning liquid from the cleaning liquid storage section.

According to this aspect of the invention, a density of contamination included in cleaning liquid applied to the cleaning roller can be detected directly. Therefore, the liquid supplying section can supply new cleaning liquid to the cleaning liquid storage section in accordance with the density of contamination (contamination degree) of cleaning liquid stored in the cleaning liquid storage section, so that lowering of ability of cleaning the conveying belt can be prevented. Thus, an adequate cleaning ability can be maintained without wastefully losing cleaning liquid. Consequently, the conveying belt can be cleaned efficiently.

Further, according to the aspect of the present invention, even when jamming of a recording sheet and deformation of a recording sheet occurs during conveying of the recording medium, a situation where cleaning liquid still having sufficient cleaning ability is replaced and a situation where cleaning liquid including a large amount of ink is not replaced can be prevented from occurring. Thus, an adequate cleaning ability can be maintained without wastefully losing cleaning liquid, so that the conveying belt can be cleaned efficiently. Therefore, image forming can be performed without contaminating a recording medium or the like, which is in contact with a surface of a conveying belt, with ink.

This application is based on Japanese Patent application serial No. 2007-56834 filed in Japan Patent Office on Mar. 7, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An inkjet recording apparatus which discharges ink onto a recording medium to form an image, the inkjet recording apparatus comprising:

a recording head having a nozzle for discharging ink;

a conveying belt for supporting a recording medium and conveying the recording medium to a position facing the nozzle;

a cleaning roller for cleaning the conveying belt;

a cleaning liquid storage section for storing cleaning liquid to be applied to the cleaning roller;

a contamination detector for detecting a density of contamination of the cleaning liquid stored in the cleaning liquid storage section;

a liquid supplying section for controlling supply of cleaning liquid to the cleaning liquid storage section in accordance with a density of contamination detected by the contamination detector, wherein the liquid supplying section supplies cleaning liquid when the density of contamination detected by the contamination detector is greater than a predetermined threshold value, and stops the supply of the cleaning liquid when the detected density of contamination is smaller than the predetermined threshold value;

a liquid draining section for draining at least a part of the cleaning liquid from the cleaning liquid storage section; and an alarming section for giving alarm, when a supply rate of cleaning liquid is at a maximum supply rate of the liquid supplying section during supply of cleaning liquid by the liquid supplying section, and the density of contamination does not become lower than the predetermined threshold value within a predetermined time after the beginning of the supply of cleaning liquid at the maximum supply rate.

2. The inkjet recording apparatus according to claim 1, wherein the liquid supplying section adjusts a supply rate of the cleaning liquid according to the detected density of contamination.

3. The inkjet recording apparatus according to claim 1, wherein the cleaning roller comes in contact with a surface of the conveying belt at a position other than a position at which the recording medium is placed.

4. The inkjet recording apparatus according to claim 1, wherein the cleaning roller is so provided that at least a part of the cleaning roller is soaked in cleaning liquid stored in the cleaning liquid storage section.

5. The inkjet recording apparatus according to claim 1, wherein:

the contamination detector detects a contamination degree of ink in cleaning liquid stored in the cleaning liquid storage section, and the liquid supplying section controls a supply rate of cleaning liquid to the cleaning liquid storage section in accordance with the contamination degree of ink detected by the contamination detector.

6. The inkjet recording apparatus according to claim 1, wherein:

the contamination detector includes:

a light emitting section for irradiating light to cleaning liquid; and a light receiver for receiving the light irradiated from the light emitting section and transmitted through cleaning liquid, and the contamination detector detects the density of contamination in accordance with intensity of the light received by the light receiver.

7. An inkjet recording apparatus which discharges ink onto a recording medium to form an image, the inkjet recording apparatus comprising:

a recording head having a nozzle for discharging ink;

a conveying belt for supporting a recording medium and conveying the recording medium to a position facing the nozzle;

a cleaning roller for cleaning the conveying belt;

a cleaning liquid storage section for storing cleaning liquid to be applied to the cleaning roller;

a contamination detector for detecting a density of contamination of the cleaning liquid stored in the cleaning liquid storage section;

a liquid supplying section for controlling supply of cleaning liquid to the cleaning liquid storage section in accordance with a density of contamination detected by the contamination detector, wherein the liquid supplying section supplies cleaning liquid when the density of contamination detected by the contamination detector is greater than a predetermined threshold value, and stops the supply of the cleaning liquid when the detected density of contamination is smaller than the predetermined threshold value;

a liquid draining section for draining at least a part of the cleaning liquid from the cleaning liquid storage section; and wherein when the cleaning liquid supply rate during the supply of the cleaning liquid by the liquid supplying section is at a maximum supply rate of the liquid supplying section, and the density of contamination does not become lower than the predetermined threshold value within a predetermined time after the supply of cleaning liquid at the maximum supply rate, the liquid supplying section stops the supply of cleaning liquid, and the liquid draining section drains all of cleaning liquid stored in the cleaning liquid storage section, and after the draining of cleaning liquid, the liquid supplying section supplies a predetermined amount of cleaning liquid to the cleaning liquid storage section.

8. The inkjet recording apparatus according to claim 7, further comprising:

an alarming section for giving alarm, when a supply rate of cleaning liquid is at a maximum supply rate of the liquid supplying section during supply of cleaning liquid by the liquid supplying section, and the density of contamination does not become lower than the predetermined threshold value within a predetermined time after the beginning of the supply of cleaning liquid at the maximum supply rate.

9. The inkjet recording apparatus according to claim 7, wherein the cleaning roller comes in contact with a surface of the conveying belt at a position other than a position at which the recording medium is placed.

10. The inkjet recording apparatus according to claim 7, wherein the cleaning roller is so provided that at least a part of the cleaning roller is soaked in cleaning liquid stored in the cleaning liquid storage section.

11. The inkjet recording apparatus according to claim 7, wherein:

the contamination detector detects a contamination degree of ink in cleaning liquid stored in the cleaning liquid storage section, and the liquid supplying section controls a supply rate of cleaning liquid to the cleaning liquid storage section in accordance with the contamination degree of ink detected by the contamination detector.

12. The inkjet recording apparatus according to claim 7, wherein:

the contamination detector includes:

a light emitting section for irradiating light to cleaning liquid; and a light receiver for receiving the light irradiated from the light emitting section and transmitted through cleaning liquid, and the contamination detector detects the density of contamination in accordance with intensity of the light received by the light receiver.

13. An inkjet recording apparatus which discharges ink onto a recording medium to form an image, the inkjet recording apparatus comprising:

a recording head having a nozzle for discharging ink;

a conveying belt for supporting a recording medium and conveying the recording medium to a position facing the nozzle;

a cleaning roller for cleaning the conveying belt;

a cleaning liquid storage section for storing cleaning liquid to be applied to the cleaning roller;

a contamination detector for detecting a density of contamination of the cleaning liquid stored in the cleaning liquid storage section;

a liquid supplying section for controlling supply of cleaning liquid to the cleaning liquid storage section in accordance with a density of contamination detected by the contamination detector, wherein the liquid supplying section supplies cleaning liquid when the density of contamination detected by the contamination detector is greater than a predetermined threshold value, and stops the supply of the cleaning liquid when the detected density of contamination is smaller than the predetermined threshold value, and wherein the liquid supplying section adjusts a supply rate of the cleaning liquid according to the detected density of contamination;

a liquid draining section for draining at least a part of the cleaning liquid from the cleaning liquid storage section; and wherein when the cleaning liquid supply rate during the supply of the cleaning liquid by the liquid supplying section is at a maximum supply rate of the liquid supplying section, and the density of contamination does not become lower than the predetermined threshold value within a predetermined time after the supply of cleaning liquid at the maximum supply rate, the liquid supplying section stops the supply of cleaning liquid, and the liquid draining section drains all of cleaning liquid stored in the cleaning liquid storage section, and after the draining of cleaning liquid, the liquid supplying section supplies a predetermined amount of cleaning liquid to the cleaning liquid storage section.

14. The inkjet recording apparatus according to claim 13, further comprising:

an alarming section for giving alarm, when a supply rate of cleaning liquid is at a maximum supply rate of the liquid supplying section during supply of cleaning liquid by the liquid supplying section, and the density of contamination does not become lower than the predetermined threshold value within a predetermined time after the beginning of the supply of cleaning liquid at the maximum supply rate.

15. The inkjet recording apparatus according to claim 13, further comprising:

an alarming section for giving alarm, when a supply rate of cleaning liquid is at a maximum supply rate of the liquid supplying section during supply of cleaning liquid by the liquid supplying section, and the density of contamination does not become lower than the predetermined threshold value within a predetermined time after the beginning of the supply of cleaning liquid at the maximum supply rate.

16. The inkjet recording apparatus according to claim 13, wherein the cleaning roller comes in contact with a surface of the conveying belt at a position other than a position at which the recording medium is placed.

17. The inkjet recording apparatus according to claim 13, wherein the cleaning roller is so provided that at least a part of the cleaning roller is soaked in cleaning liquid stored in the cleaning liquid storage section.

18. The inkjet recording apparatus according to claim 13, wherein:

the contamination detector detects a contamination degree of ink in cleaning liquid stored in the cleaning liquid storage section, and the liquid supplying section controls a supply rate of cleaning liquid to the cleaning liquid storage section in accordance with the contamination degree of ink detected by the contamination detector.

19. The inkjet recording apparatus according to claim 13, wherein:

the contamination detector includes:

a light emitting section for irradiating light to cleaning liquid; and a light receiver for receiving the light irradiated from the light emitting section and transmitted through cleaning liquid, and the contamination detector detects the density of contamination in accordance with intensity of the light received by the light receiver.

* * * * *